US010520841B2

(12) United States Patent
Sato et al.

(10) Patent No.: US 10,520,841 B2
(45) Date of Patent: Dec. 31, 2019

(54) ELECTROSTATIC IMAGE DEVELOPING TONER, ELECTROSTATIC LATENT IMAGE DEVELOPER, AND TONER CARTRIDGE

(71) Applicant: FUJI XEROX CO., LTD., Tokyo (JP)

(72) Inventors: Narumasa Sato, Kanagawa (JP); Erina Saito, Kanagawa (JP); Yuka Kawamoto, Kanagawa (JP); Noriyuki Mizutani, Kanagawa (JP); Kotaro Yoshihara, Kanagawa (JP); Daisuke Ishizuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/121,648

(22) Filed: Sep. 5, 2018

(65) Prior Publication Data

US 2019/0294063 A1 Sep. 26, 2019

(30) Foreign Application Priority Data

Mar. 23, 2018 (JP) ..... 2018-057226

(51) Int. Cl.

| | |
|---|---|
| ***G03G 9/087*** | (2006.01) |
| ***G03G 9/08*** | (2006.01) |
| ***G03G 9/097*** | (2006.01) |

(52) U.S. Cl.

CPC ..... *G03G 9/0825* (2013.01); *G03G 9/0804* (2013.01); *G03G 9/08755* (2013.01); *G03G 9/08782* (2013.01); *G03G 9/08786* (2013.01); *G03G 9/08788* (2013.01); *G03G 9/08791* (2013.01); *G03G 9/09733* (2013.01)

(58) Field of Classification Search

CPC ..... G03G 9/0825; G03G 9/09786; G03G 9/08788; G03G 9/08791; G03G 9/08782; G03G 9/08755; G03G 9/08711

USPC ..... 430/110.1, 109.3, 109.4

See application file for complete search history.

(56) References Cited

U.S. PATENT DOCUMENTS

| | | | |
|---|---|---|---|
| 9,304,421 | B2 | 4/2016 | Sekiguchi et al. |
| 9,354,535 | B2 | 5/2016 | Kouyama et al. |
| 9,696,645 | B2 | 7/2017 | Mine et al. |
| 9,703,222 | B2 | 7/2017 | Mine et al. |
| 2016/0313661 | A1* | 10/2016 | Sekiguchi ..... G03G 9/09733 |

FOREIGN PATENT DOCUMENTS

| | | |
|---|---|---|
| JP | 2015052643 | 3/2015 |
| JP | 2016004060 | 1/2016 |
| JP | 5983653 | 9/2016 |
| JP | 2016161782 | 9/2016 |
| JP | 2016224367 | 12/2016 |

* cited by examiner

*Primary Examiner* — Janis L Dote

(74) *Attorney, Agent, or Firm* — JCIPRNET

(57) ABSTRACT

An electrostatic image developing toner includes a toner particle and an external additive. The toner particle contains a binder resin and a release agent that includes a hydrocarbon wax. The binder resin includes a vinyl resin and a hybrid resin in which an amorphous resin unit other than polyester resins and a crystalline polyester resin unit are chemically bound together. The toner particle has hybrid resin domains and release agent domains. An average distance Lhyb from the surface of the toner particle to the centers of the hybrid resin domains and an average distance Lwax from the surface of the toner particle to the centers of the release agent domains satisfy Lwax<Lhyb.

17 Claims, 3 Drawing Sheets

ELECTROSTATIC IMAGE DEVELOPING TONER, ELECTROSTATIC LATENT IMAGE DEVELOPER, AND TONER CARTRIDGE

CROSS-REFERENCE TO RELATED APPLICATIONS

This application is based on and claims priority under 35 USC 119 from Japanese Patent Application No. 2018-057226 filed Mar. 23, 2018.

BACKGROUND

(i) Technical Field

The present disclosure relates to an electrostatic image developing toner, an electrostatic latent image developer, and a toner cartridge.

(ii) Related Art

There have been known techniques that use electrostatic image developing toners to form electrophotographic images.

Japanese Unexamined Patent Application Publication No. 2016-161782 discloses "an electrostatic image developing toner containing a binder resin that includes an amorphous resin and a hybrid crystalline polyester resin which has specific thermal properties and in which an amorphous resin unit other than polyester resins and a crystalline polyester resin unit are chemically bound together".

Japanese Unexamined Patent Application Publication No. 2016-224367 discloses "an electrostatic latent image developing toner containing toner base particles that contain a specific crystal nucleating agent and a binder resin including a hybrid crystalline resin.

Japanese Unexamined Patent Application Publication No. 2015-052643 discloses "an electrostatic latent image developing toner including toner base particles that contain at least a binder resin and have a domain-matrix structure".

Japanese Unexamined Patent Application Publication No. 2015-052643 also discloses that the domain-matrix structure is formed of a matrix containing a styrene-acrylic resin and domains containing an amorphous resin in which a vinyl polymer segment and a polyester polymer segment are bound together and having a number-average size of 150 nm or more and 1,000 nm or less.

Japanese Unexamined Patent Application Publication No. 2016-004060 discloses "an electrostatic image developing toner containing a binder resin and a colorant, the binder resin being obtained by performing miniemulsion polymerization using an oil-phase solution of a urethane-modified crystalline polyester resin in an ethylenically unsaturated monomer, the toner being formed by aggregating and fusing fine particles of the binder resin and fine particles of the colorant".

Japanese Patent No. 5983653 discloses "an electrostatic image developing toner including a toner particle that contains a binder resin, a colorant, and a release agent, the binder resin including a urethane-modified crystalline polyester resin having a specific acid value and specific thermal properties and an amorphous resin".

SUMMARY

It has been known that the use of an electrostatic image developing toner including a toner particle that contains a release agent and a binder resin including a vinyl resin and a hybrid resin in which an amorphous resin unit and a crystalline resin unit are chemically bound together provides low-temperature fixability. However, when such an electrostatic image developing toner is used, a phenomenon (filming) may occur in which toner components slip through a blade and adhere to a surface of an image carrier to form a coating.

Aspects of non-limiting embodiments of the present disclosure relate to an electrostatic image developing toner including a toner particle and an external additive, the toner particle containing a release agent and a binder resin including a hybrid resin and a vinyl resin. The electrostatic image developing toner has higher low-temperature fixability and is less likely to cause filming after storage at high temperature than when an average distance Lhyb from the surface of the toner particle to the centers of hybrid resin domains and an average distance Lwax from the surface of the toner particle to the centers of release agent domains satisfy Lwax>Lhyb.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrostatic image developing toner comprising:

a toner particle; and an external additive, the toner particle containing a binder resin and a release agent that includes a hydrocarbon wax, the binder resin including a vinyl resin and a hybrid resin in which an amorphous resin unit other than polyester resins and a crystalline polyester resin unit are chemically bound together, wherein the toner particle has hybrid resin domains and release agent domains, and an average distance Lhyb from a surface of the toner particle to centers of the hybrid resin domains and an average distance Lwax from the surface of the toner particle to centers of the release agent domains satisfy Lwax<Lhyb.

BRIEF DESCRIPTION OF THE DRAWINGS

Exemplary embodiments of the present disclosure will be described in detail based on the following figures, wherein.

DETAILED DESCRIPTION

Figure 1:
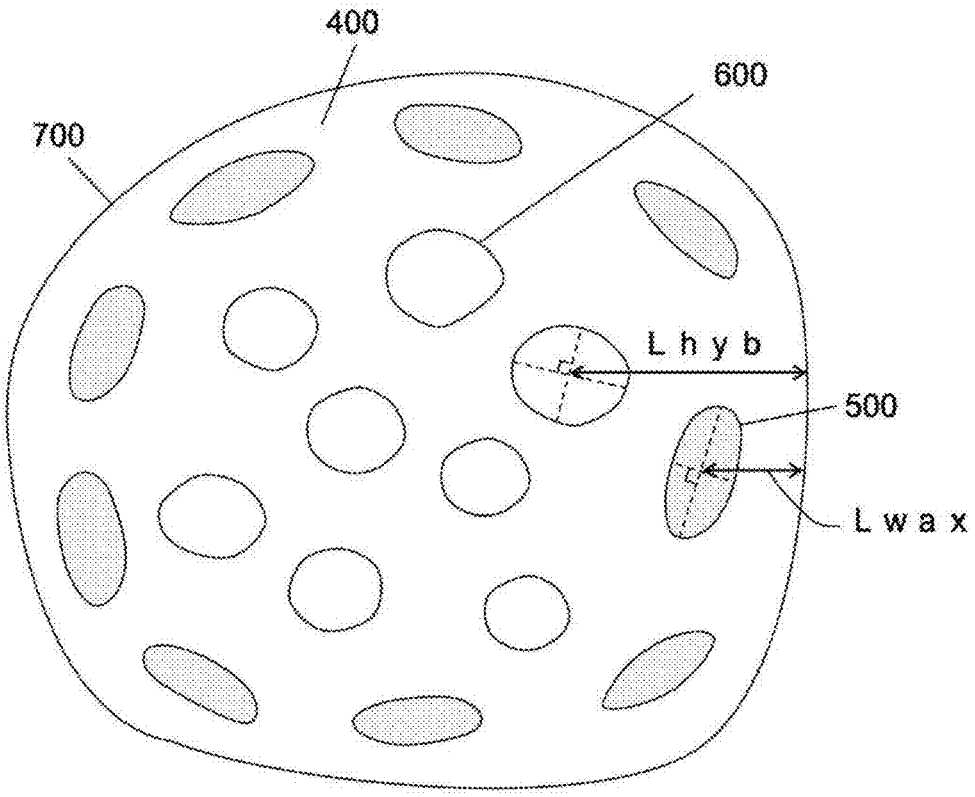
FIG. 1 is a schematic sectional view of a toner particle according to an exemplary embodiment.

Exemplary embodiments of the present disclosure will hereinafter be described.

In the exemplary embodiments, if there are two or more substances corresponding to one component in an object, the amount of the component in the object refers to the total amount or content of the two or more substances in the object, unless otherwise specified.

Electrostatic Image Developing Toner

In first and second embodiments, an electrostatic image developing toner is also referred to simply as a "toner". In the first and second embodiments, a resin in which an amorphous resin unit other than polyester resins and a crystalline polyester resin unit are chemically bound together is referred to as a hybrid resin.

A toner according to the first embodiment includes toner particles and an external additive. The toner particles contain a binder resin and a release agent. The binder resin includes a hybrid resin and a vinyl resin.

In the toner according to the first embodiment, each toner particle has hybrid resin domains and release agent domains. An average distance Lhyb from the surface of the toner particle to the centers of the hybrid resin domains and an average distance Lwax from the surface of the toner particle to the centers of the release agent domains satisfy Lwax<Lhyb.

It has been known that using a toner including an external additive and toner particles that contain a release agent and a binder resin including a hybrid resin and a vinyl resin provides low-temperature fixability. However, if a toner having such a composition is used to form an image after storage at high temperature (e.g., 45° C.), a phenomenon (filming) tends to occur in which toner components remaining in an area of contact between an image carrier and a blade slip through the blade and adhere to the surface of the image carrier to form a coating. Although not fully understood, the filming occurs probably due to the following reason.

When a toner including toner particles and an external additive added thereto is applied to an image forming apparatus, the external additive is separated from the toner particles, for example, under the influence of external force such as mechanical load and during transfer. The toner particles are then dammed at the front end of the area of contact (the region on the downstream side in the rotational direction of the image carrier in the area of contact between the blade and the image carrier), and an aggregate (hereinafter also referred to as a "toner dam") is formed by the pressure from the blade. In addition, the separated external additive, when reaching the area of contact between the blade and the image carrier, is dammed in the front end region of the area of contact at a position closer to the area of contact than the toner dam is to the area of contact, and an aggregate (hereinafter also referred to as an "external additive dam") is formed by the pressure from the blade. This external additive dam provides improved cleanability (toner scraping properties).

For example, if the toner is stored at high temperature, the hybrid resin may move to the surface side of the toner particles. When the hybrid resin moves to the surface side of the toner particles, the external additive adhering to the surface of the toner particles tends to sink because the crystalline polyester resin unit in the hybrid resin has soft properties. If the external additive sinks into the toner particles, the external additive is less likely to separate from the toner particles even when external force such as mechanical load is applied to the toner. Thus, the aforementioned external additive dam is less likely to form, and the cleanability provided by the external additive dam tends to be low. More specifically, the reduced likelihood of the formation of the external additive dam may give rise to a local load on the blade, leading to a phenomenon in which the blade is locally curled. This increases the likelihood that the toner components remaining in the area of contact between the image carrier and the blade slip through the blade. As a result, filming will probably occur after a toner image is transferred.

By contrast, in the toner according to the first embodiment, for example, a continuous vinyl resin phase, hybrid resin domains, and release agent domains, the release agent including a hydrocarbon wax, are formed in each toner particle, as shown in FIG. 1. The average distance Lhyb from the surface of the toner particle to the centers of the hybrid resin domains and the average distance Lwax from the surface of the toner particle to the centers of the release agent domains satisfy Lwax<Lhyb. In other words, in the toner particle, the hybrid resin domains are present inwardly in a higher proportion than the release agent domains, and the hybrid resin is less likely to move to the surface side of the toner particle after storage of the toner at high temperature. Thus, the surface of the toner particle will not become excessively soft, decreasing the likelihood that the external additive sinks. As a result, the maintenance of the cleanability provided by the external additive dam may be enhanced, and the occurrence of filming may be suppressed if the toner is stored at high temperature. In FIG. 1, 700 represents a toner particle, 600 represents a hybrid resin domain, 500 represents a release agent domain, and 400 represents a continuous vinyl resin phase.

The presence of the hydrocarbon wax in the release agent may enhance the affinity of the release agent for the hybrid resin. Thus, the movement of the hybrid resin to the surface of the toner particle tends to be suppressed more efficiently. As a result, the occurrence of filming after storage of the toner at high temperature may be further suppressed. Furthermore, in the toner according to the first embodiment, the release agent domains tend to be present near the toner surface in a high proportion, and thus the release agent may readily ooze out of the toner particle and readily exhibit its intrinsic function.

A toner according to the second embodiment includes toner particles and an external additive. The toner particles contain a binder resin and a release agent. The binder resin includes a hybrid resin and a vinyl resin.

In the toner according to the second embodiment, each toner particle has hybrid resin domains and release agent domains. The average area fraction of release agent domains present in a region extending from the center of the toner particle toward the surface of the toner particle by half the distance from the surface to the center is larger than the average area fraction of hybrid resin domains present in the region. The average area fraction of release agent domains present in a region extending from the surface of the toner particle toward the center of the toner particle by half the distance from the surface to the center is smaller than the average area fraction of hybrid resin domains present in the region.

As described above, if a conventional toner is stored at high temperature, the hybrid resin may move to the surface side of the toner particles. More specifically, the average area fraction of release agent domains present in a region extending from the center of the toner particle toward the surface of the toner particle by half the distance from the surface to the center tends to be smaller than the average area fraction of hybrid resin domains present in the region. By contrast, the average area fraction of release agent domains present in a region extending from the surface of the toner particle toward the center of the toner particle by half the distance from the surface to the center tends to be larger than the average area fraction of hybrid resin domains present in the region. In a conventional toner having such a configuration, the external additive adhering to the surface of the toner particles tends to sink. If the external additive sinks into the toner particles, the external additive is less likely to separate from the toner particles even when external force such as mechanical load is applied to the toner. Thus, the aforementioned external additive dam is less likely to form, and the cleanability provided by the external additive dam tends to be low. More specifically, the reduced likelihood of the formation of the external additive dam may give rise to a local load on the blade, leading to a phenomenon in which the blade is locally curled or chipped. This increases the likelihood that the toner components remaining in the area of contact between the image carrier and the blade slip through the blade. As a result, filming will probably occur after a toner image is transferred.

The toner according to the second embodiment has the above-described configuration, and hence in each toner particle, the hybrid resin domains are present inwardly in a higher proportion than the release agent domains, and the hybrid resin is less likely to move to the surface side of the toner particle. Thus, the surface of the toner particle will not become excessively soft, decreasing the likelihood that the external additive sinks. As a result, the toner may have cleanability provided by the external additive dam, and the occurrence of filming after storage of the toner at high temperature may be suppressed.

As with the toner according to the first embodiment, the presence of the hydrocarbon wax in the release agent may further suppress the occurrence of filming after storage of the toner at high temperature. Furthermore, the release agent may readily exhibit its intrinsic function.

The configuration of the toner according to the first and second embodiments (hereinafter referred to collectively as "the exemplary embodiment" for convenience) will hereinafter be described in detail. Reference numerals are omitted in the description.

The toner according to the exemplary embodiment includes toner particles and an external additive.

Toner Particles

The toner particles will now be described.

The toner particles contain a binder resin and a release agent. The binder resin includes a hybrid resin and a vinyl resin, and the release agent includes a hydrocarbon wax. The toner particles according to the exemplary embodiment may optionally include other components.

Properties of Toner Particles

The properties of the toner particles will now be described.

The toner particles each have hybrid resin domains and release agent domains in the binder resin.

Lwax and Lhyb

In each toner particle, the average distance Lhyb from the surface of the toner particle to the centers of the hybrid resin domains and the average distance Lwax from the surface of the toner particle to the centers of the release agent domains satisfy Lwax<Lhyb.

Figure 2:
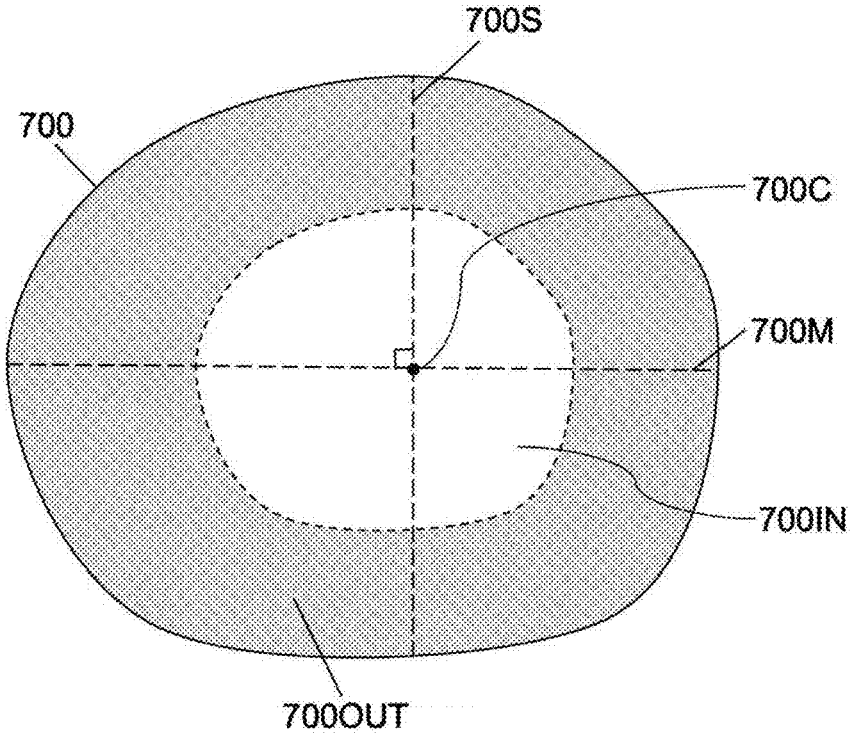
FIG. 2 is a schematic sectional view of a toner particle according to another exemplary embodiment.

The center of a hybrid resin domain or a release agent domain is a point of intersection of the major axis and the minor axis of the domain, as shown in FIG. 2, for example. The major axis of a domain is a longest straight-line distance between any two points on the surface of the domain. The minor axis of the domain is a longest straight-line distance between any two points perpendicular to the major axis.

Lwax is an arithmetic average of shortest distances from the surface of the toner particle to the centers of the release agent domains.

Lhyb is an arithmetic average of shortest distances from the surface of the toner particle to the centers of the hybrid resin domains.

If Lhyb and Lwax satisfy Lwax<Lhyb, that is, the distance from the surface of the toner particle to the centers of the hybrid resin domains is longer than the distance from the surface of the toner particle to the centers of the release agent domains, the hybrid resin will probably be less likely to move to the surface of the toner particle. As a result, the occurrence of filming after storage of toner at high temperature may be suppressed.

Lwax is preferably 0.4 μm or more and 1.0 μm or less, more preferably 0.5 μm or more and 0.9 μm or less, still more preferably 0.6 μm or more and 0.8 μm or less.

When Lwax is 1.0 μm or less, the release agent domains are probably present near the surface of the toner particle in a high proportion. In this case, the hydrocarbon wax in the release agent probably has a high affinity for the hybrid resin. This tends to efficiently inhibit the hybrid resin domain from moving to the surface of the toner particle. As a result, the occurrence of filming after storage at high temperature tends to be further suppressed.

In addition, since the hybrid resin tends to be appropriately present near the toner particle surface together with the release agent, the toner particle surface apparently has a low Tg, and the low-temperature fixability resulting from the release agent and the hybrid resin probably tends to be higher. As a result, the low-temperature fixability of halftone images (e.g., an image having an area coverage of 50%) to, for example, rough paper which poorly conducts heat will probably also be higher.

Lwax and Lhyb may be controlled to be within the above-described range, for example, by the following method. For example, in the aggregation step in producing toner particles, which step will be described later, a hybrid resin particle dispersion, a vinyl resin particle dispersion, and a pigment are mixed together in advance to cause aggregation. The vinyl resin particle dispersion is then mixed to cause aggregation, and lastly, a mixed solution of a release agent particle dispersion and a vinyl resin dispersion is added to cause further aggregation.

Average Size of Domains

To provide low-temperature fixability and suppress the occurrence of filming after storage of toner at high temperature, the release agent domains preferably have an average size of 0.5 μm or more and less than 2.0 μm, more preferably 0.6 μm or more and less than 1.8 μm, still more preferably 0.7 μm or more and less than 1.6 μm.

The hybrid resin domains preferably have an average size of 0.4 μm or more and less than 1.2 μm, more preferably 0.5 μm or more and less than 1.0 μm, still more preferably 0.6 μm or more and less than 0.8 μm.

To provide low-temperature fixability and suppress the occurrence of filming after storage of toner at high temperature, the ratio of the average size of the release agent domains to the average size of the hybrid resin domains (average size of release agent domains/average size of hybrid resin domains) is preferably 0.3 or more and 1.0 or less, more preferably 0.4 or more and 0.9 or less, still more preferably 0.5 or more and 0.8 or less.

To provide low-temperature fixability and suppress the occurrence of filming after storage of toner at high temperature, Lhyb is preferably 0.6 μm or more and 3.0 μm or less, more preferably 0.8 μm or more and 2.5 μm or less, still more preferably 1.0 μm or more and 2.0 μm or less.

The average size of the release agent domains may be controlled, for example, by the following method. In producing toner particles by aggregation coalescence, the volume-average particle size of release agent particles in the release agent particle dispersion used in the production is adjusted; a plurality of release agent particle dispersions having different volume-average particle sizes are provided and used in combination; the heating rate and the solids content in the dispersions in the aggregated particle forming steps are adjusted; the temperature (e.g., quenching conditions) in the fusion and coalescence step is adjusted; and/or the amount of surfactant is adjusted. The average size of the hybrid resin domains may also be controlled in the same manner.

Average Area Fraction of Domains

The average area fraction of release agent domains present in a region extending from the center of the toner particle toward the surface of the toner particle by half the distance from the surface to the center is larger than the average area fraction of hybrid resin domains present in the region. The average area fraction of release agent domains present in a region extending from the surface of the toner particle toward the center of the toner particle by half the distance from the surface to the center is smaller than the average area fraction of hybrid resin domains present in the region.

The center of the toner particle is a point of intersection of the major axis and the minor axis of the toner particle, as shown in FIG. 2, for example. The major axis of the toner particle is a longest straight-line distance between any two points on the surface of the toner particle. The minor axis of the toner particle is a longest straight-line distance between any two points perpendicular to the major axis. In FIG. 2, 700 represents the toner particle, 700M represents the major axis of the toner particle, 700S represents the minor axis of the toner particle, and 700C represents the center of the toner particle. 700OUT represents "the region extending from the surface of the toner particle toward the center of the toner particle by half the distance from the surface to the center", and 7001N represents "the region extending from the center of the toner particle toward the surface of the toner particle by half the distance from the surface to the center".

When the average area fraction of the release agent domains is larger than the average area fraction of the hybrid resin domains in the region extending from the center of the toner particle toward the surface of the toner particle by half the distance from the surface to the center, the release agent domains are likely to intervene between the hybrid resin domains and an external additive on the surface of the toner particle. This will probably inhibit the hybrid resin from moving to the surface of the toner particle. As a result, the toner may have low-temperature fixability, and the occurrence of filming after storage at high temperature may be suppressed.

The average area fractions of the hybrid resin domains and the release agent domains in the region extending from the center of the toner particle toward the surface of the toner particle by half the distance from the surface to the center and the region extending from the surface of the toner particle toward the center of the toner particle by half the distance from the surface to the center may be controlled to be as described above, for example, by the same method as the method for controlling Lwax and Lhyb.

The average area fraction of the release agent domains in the entire toner particle is preferably 5% or more and 25% or less, more preferably 8% or more and 22% or less, still more preferably 10% or more and 20% or less.

The average area fraction of the hybrid resin domains in the entire toner particle is preferably 5% or more and 25% or less, more preferably 7% or more and 23% or less, still more preferably 9% or more and 21% or less.

To provide low-temperature fixability and suppress the occurrence of filming after storage of toner at high temperature, the ratio of the average area fraction of the release agent domains in the entire toner particle to the average area fraction of the hybrid resin domains in the entire toner particle (average area fraction of release agent domains in entire toner particle/average area fraction of hybrid resin domains in entire toner particle) is preferably 0.5 or more and 2.0 or less, more preferably 0.7 or more and 1.8 or less, still more preferably 0.9 or more and 1.6 or less.

Methods for measuring Lhyb, Lwax, and the average area fraction, domain size, and average number of the domains will hereinafter be described.

The toner is mixed and embedded in epoxy resin, and the epoxy resin is cured. The resulting cured resin is then sliced with an ultramicrotome (Ultracut UCT manufactured by Leica Microsystems) to prepare a sample section having a thickness of 80 nm or more and 130 nm or less. The sample section is then stained with osmium tetraoxide in a desiccator at 30° C. for 3 hours. An SEM image of the stained sample section is captured under a super-resolution field-emission scanning electron microscope (SEM: S-4800, manufactured by Hitachi High-Technologies Corporation). Here, the hybrid resin, the vinyl resin, and the release agent are distinguished by the density depending on the degree of staining since they are more easily stained with osmium tetraoxide in the above order. If the density is difficult to determine, for example, depending on the sample condition, the staining time is adjusted.

The average distance Lhyb from the surface of the toner particle to the centers of the hybrid resin domains is determined by the following method.

(1) In the above SEM image, a toner particle section having a maximum length larger than or equal to 85% of the volume-average particle size of the toner particles is selected, and a stained hybrid resin domain is observed.

(2) The major axis and the minor axis of the selected hybrid resin domain are determined. The point of intersection of the major axis and the minor axis is used as the center of the hybrid resin domain.

(3) The shortest distance from the surface of the toner particle to the center of the selected hybrid resin domain is determined.

(4) The above steps (1) to (3) are performed on 100 hybrid resin domains in a plurality of toner particles, and the arithmetic average of the measurements is calculated to determine the average distance Lhyb.

The average distance Lwax from the surface of the toner particle to the centers of the release agent domains is determined by the following method.

(1) In the above SEM image, a toner particle section having a maximum length larger than or equal to 85% of the volume-average particle size of the toner particles is selected, and a stained release agent domain is observed.

(2) The major axis and the minor axis of the selected release agent domain are determined. The point of intersection of the major axis and the minor axis is used as the center of the release agent domain.

(3) The shortest distance from the surface of the toner particle to the center of the selected release agent domain is determined.

(4) The above steps (1) to (3) are performed on 100 release agent domains in a plurality of toner particles, and the arithmetic average of the measurements is calculated to determine the average distance Lwax.

The average area fraction of release agent domains present in a region extending from the center of the toner particle toward the surface of the toner particle by half the distance from the surface to the center (hereinafter also referred to as "the average area fraction of the first specific release agent domains") is determined by the following method.

(1) In the above SEM image, a toner particle section having a maximum length larger than or equal to 85% of the volume-average particle size of the toner particles is observed.

(2) The major axis and the minor axis of the selected toner particle section are determined. The point of intersection of the major axis and the minor axis is used as the center of the toner particle.

(3) In the selected toner particle section, the area of the region extending from the center of the toner particle toward the surface of the toner particle by half the distance from the surface to the center is determined.

(4) The area of first specific release agent domains is determined. If a release agent domain is present on the boundary of the region extending from the center of the toner particle toward the surface of the toner particle by half the distance from the surface to the center, the area of a part of the release agent domain that overlaps the region extending from the center of the toner particle toward the surface of the toner particle by half the distance from the surface to the center is included in the area of the first specific release agent domains.

(5) Area fraction (%) of first specific release agent domains=(area of first specific release agent domains/area of region extending from center of toner particle toward surface of toner particle by half distance from surface to center)×100 is calculated.

(6) The above steps (1) to (5) are performed on 100 toner particles, and the arithmetic average of the measurements is calculated to determine the average area fraction.

The average area fraction of hybrid resin domains present in a region extending from the center of the toner particle toward the surface of the toner particle by half the distance from the surface to the center (hereinafter also referred to as "the average area fraction of the first specific hybrid resin domains") is determined in the same manner as for the average area fraction of the first specific release agent domains.

The average area fraction of release agent domains present in a region extending from the surface of the toner particle toward the center of the toner particle by half the distance from the surface to the center (hereinafter also referred to as "the average area fraction of the second specific release agent domains") is determined by the following method.

(1) In the above SEM image, a toner particle section having a maximum length larger than or equal to 85% of the volume-average particle size of the toner particles is observed.

(2) The major axis and the minor axis of the selected toner particle section are determined. The point of intersection of the major axis and the minor axis is used as the center of the toner particle.

(3) In the selected toner particle section, the area of the region extending from the surface of the toner particle toward the center of the toner particle by half the distance from the surface to the center is determined.

(4) The area of second specific release agent domains is determined. If a release agent domain is present on the boundary of the region extending from the surface of the toner particle toward the center of the toner particle by half the distance from the surface to the center, the area of a part of the release agent domain that overlaps the region extending from the surface of the toner particle toward the center of the toner particle by half the distance from the surface to the center is included in the area of the second specific release agent domains.

(5) Area fraction (%) of second specific release agent domains=(area of second specific release agent domains/area of region extending from surface of toner particle toward center of toner particle by half distance from surface to center)×100 is calculated.

(6) The above steps (1) to (5) are performed on 100 toner particles, and the arithmetic average of the measurements is calculated to determine the average area fraction.

The average area fraction of hybrid resin domains present in a region extending from the surface of the toner particle toward the center of the toner particle by half the distance from the surface to the center (hereinafter also referred to as "the average area fraction of the second specific hybrid resin domains") is determined in the same manner as for the average area fraction of the second specific release agent domains.

The average area fraction of the release agent domains in the entire toner particle is determined by the following method. The average area fraction of the hybrid resin domains in the entire toner particle is also determined by the following method.

(1) In the above SEM image, a toner particle section having a maximum length larger than or equal to 85% of the volume-average particle size of the toner particles is selected, and stained release agent domains are observed.

(2) The area of the selected toner particle section is determined.

(3) The area of all release agent domains observed in the toner particle section is determined.

(4) Area fraction (%) of release agent domains in entire toner particle=(area of all release agent domains observed in toner particle section/area of toner particle section)×100 is calculated.

(5) The above steps (1) to (4) are performed on 100 toner particles, and the arithmetic average of the measurements is calculated to determine the average area fraction.

The ratio of the average area fraction of the release agent domains in the entire toner particle to the average area fraction of the hybrid resin domains in the entire toner particle is determined by the following method.

(1) In the above SEM image, a toner particle section having a maximum length larger than or equal to 85% of the volume-average particle size of the toner particles is selected, and stained release agent domains and hybrid resin domains are observed.

(2) The average area fraction of the release agent domains in the entire toner particle is determined by the method described above.

(3) The average area fraction of the hybrid resin domains in the entire toner particle is determined by the method described above.

(4) The ratio of the average area fraction of the release agent domains in the entire toner particle to the average area fraction of the hybrid resin domains in the entire toner particle (average area fraction of release agent domains in entire toner particle/average area fraction of hybrid resin domains in entire toner particle) is determined.

The average size of the release agent domains is determined by the following method. The average size of the hybrid resin domains is determined in the same manner as the average size of the release agent domains.

(1) In the above SEM image, a toner particle section having a maximum length larger than or equal to 85% of the volume-average particle size of the toner particles is selected, and a stained release agent domain is observed.
(2) The diameter of a circle having the same area as the area of the release agent determined in the above SEM image is calculated as an equivalent circle diameter.
(3) The above steps (1) and (2) are performed on 100 release agent domains in a plurality of toner particles, and the arithmetic average of the equivalent circle diameters is calculated to determine the average size.

The average number of release agent domains in the entire toner particle is determined by the following method. The average number of hybrid resin domains in the entire toner particle is determined in the same manner as the average number of release agent domains.
(1) In the above SEM image, a toner particle section having a maximum length larger than or equal to 85% of the volume-average particle size of the toner particles is selected.
(2) The number of all release agent domains observed in the toner particle section is counted.
(3) The above steps (1) and (2) are performed on 100 toner particles, and the arithmetic average of the measurements is calculated to determine the average number.

The ratio of the average number of release agent domains in the entire toner particle to the average number of hybrid resin domains in the entire toner particle is determined by the following method.
(1) In the above SEM image, a toner particle section having a maximum length larger than or equal to 85% of the volume-average particle size of the toner particles is selected, and stained release agent domains and hybrid resin domains are observed.
(2) The average number of release agent domains in the entire toner particle is determined by the method described above.
(3) The average number of hybrid resin domains in the entire toner particle is determined by the method described above.
(4) The ratio of the average number of release agent domains in the entire toner particle to the average number of hybrid resin domains in the entire toner particle (average number of release agent domains in entire toner particle/average number of hybrid resin domains in entire toner particle) is determined.

The toner particles preferably have a volume-average particle size D50v of 3.0 μm or more and 8.0 μm or less, more preferably 3.5 μm or more and 7.0 μm or less, still more preferably 4.0 μm or more and 6.0 μm or less.

The average particle size of the toner particles is measured using a Coulter Multisizer II (manufactured by Beckman Coulter, Inc.) and an ISOTON-II electrolyte (manufactured by Beckman Coulter, Inc).

In the measurement, 0.5 mg to 50 mg of a test sample is added to 2 ml of a 5% aqueous solution of a surfactant (e.g., sodium alkylbenzene sulfonate) serving as a dispersant. The resulting solution is added to 100 ml to 150 ml of the electrolyte.

The electrolyte containing the suspended sample is dispersed with a sonicator for 1 minute, and the particle size distribution of particles having particle sizes in the range of from 2 μm to 60 μm is measured with the Coulter Multisizer II using an aperture having an aperture diameter of 100 μm. The number of sampled particles is 50,000.

The particle size distribution obtained is divided into particle size classes (channels). A cumulative volume distribution is drawn from smaller particle sizes. The volume-average particle size D50v is defined as the particle size at which the cumulative volume is 50%.

The toner particles preferably have an average roundness of 0.94 or more and 1.00 or less, more preferably 0.95 or more and 0.98 or less The average roundness of the toner particles is determined by (perimeter of equivalent circle)/(perimeter) [(perimeter of circle having same projected area as that of particle image)/(perimeter of projected particle image)]. Specifically, the average roundness is measured by the following method.

Target toner particles are collected by suction so as to form a flat flow, and strobe light is flashed to capture a still particle image. The particle image is analyzed with a flow particle image analyzer (FPIA-3000 manufactured by SYSMEX CORPORATION). The number of particles sampled for determining the average roundness is 3,500.

When the toner contains an external additive, the toner (developer) to be measured is dispersed in water containing a surfactant and then sonicated to obtain toner particles from which the external additive has been removed.

Binder Resin

The binder resin will now be described.

The binder resin includes a vinyl resin and a hybrid resin in which an amorphous resin unit other than polyester resins and a crystalline polyester resin unit are chemically bound together. The binder resin may optionally include other binder resins.

Hybrid Resin

A description will now be given of hybrid resins.

The binder resin according to the exemplary embodiment includes a hybrid resin.

The hybrid resin is a resin in which an amorphous resin unit other than polyester resins and a crystalline polyester resin unit are chemically bound together.

The crystalline polyester resin unit refers to a resin portion having a structure derived from crystalline polyester resin. The amorphous resin unit refers to a resin portion having a structure derived from amorphous resin.

A description will now be given of (A) crystalline polyester resin unit and (B) amorphous resin unit.

(A) Crystalline Polyester Resin Unit

The crystalline polyester resin unit will now be described.

Examples of crystalline polyester resins that form the crystalline polyester resin unit (hereinafter also referred to simply as "crystalline polyester resins") include polycondensates of polycarboxylic acids and polyhydric alcohols. The crystalline polyester resin for use may be a commercially available product or may be synthesized.

Examples of polycarboxylic acids include aliphatic dicarboxylic acids (e.g., oxalic acid, succinic acid, glutaric acid, adipic acid, suberic acid, azelaic acid, sebacic acid, 1,9-dicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), and anhydrides and lower (e.g., C1 to C5) alkyl esters thereof.

The polycarboxylic acid may be a combination of such a dicarboxylic acid with a tri- or higher carboxylic acid having a cross-linked or branched structure. Examples of tricarboxylic acids include aromatic carboxylic acids (e.g., 1,2,3-benzenetricarboxylic acid, 1,2,4-benzenetricarboxylic acid, and 1,2,4-naphthalene tricarboxylic acid) and anhydrides and lower (e.g., C1 to C5) alkyl esters thereof.

The polycarboxylic acid may be a combination of such a dicarboxylic acid with a dicarboxylic acid having a sulfonic group or a dicarboxylic acid having an ethylenic double bond.

These polycarboxylic acids may be used alone or in combination.

Examples of polyhydric alcohols include aliphatic diols (e.g., linear aliphatic diols having 7 to 20 main-chain carbon atoms). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

The polyhydric alcohol may be a combination of such a diol with a tri- or higher alcohol having a cross-linked or branched structure. Examples of tri- or higher alcohols include glycerol, trimethylolethane, trimethylolpropane, and pentaerythritol.

These polyhydric alcohols may be used alone or in combination.

To provide low-temperature fixability and suppress the occurrence of filming after storage of toner at high temperature, the crystalline polyester resin unit is preferably a crystalline aliphatic polyester resin formed of a polycarboxylic acid component and a polyhydric alcohol component.

Examples of polycarboxylic acid components to form a crystalline aliphatic polyester resin include aliphatic dicarboxylic acids such as oxalic acid, malonic acid, maleic acid, fumaric acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Of these, the polycarboxylic acid component to form a crystalline aliphatic polyester resin is preferably a polycarboxylic acid component having 8 to 22 carbon atoms.

Examples of polyhydric alcohol components to form a crystalline aliphatic polyester resin include 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

Of these, the polyhydric alcohol component to form a crystalline aliphatic polyester resin is preferably a polyhydric alcohol component having 4 to 10 carbon atoms.

In the crystalline aliphatic polyester resin, the sum of the number of carbon atoms of the polycarboxylic acid component and the number of carbon atoms of the polyhydric alcohol component is preferably 8 or more and 22 or less, more preferably 10 or more and 20 or less, still more preferably 12 or more and 18 or less.

The number of carbon atoms of the polycarboxylic acid component is the total number of carbon atoms including carbon atoms of carboxy groups.

When more than one polycarboxylic acid component is used to form a crystalline aliphatic polyester resin, the weighted average resulting from the multiplication by the molar ratio of each polycarboxylic acid component is used as the number of carbon atoms of the polycarboxylic acid component. When more than one polyhydric alcohol component is used to form a crystalline aliphatic polyester resin, the weighted average resulting from the multiplication by the molar ratio of each polyhydric alcohol component is used as the number of carbon atoms of the polyhydric alcohol component.

The number of carbon atoms of the polycarboxylic acid component and the polyhydric alcohol component of the crystalline aliphatic polyester resin is determined by pyrolysis-gas chromatography-mass spectrometry (pyrolysis-GCMS) in the following manner.

(1) Separation of Crystalline Aliphatic Polyester Resin

The external additive is separated from the toner by the following procedure. The toner is placed into a 5% aqueous solution of a surfactant (e.g., sodium alkylbenzene sulfonate) serving as a dispersant and blended by stirring. The resulting solution is then sonicated with a bath-type sonicator to separate the external additive from the surface of the toner particles. Thereafter, the toner particles are allowed to settle by centrifugation. The supernatant fluid in which the separated external additive is dispersed is removed. This procedure from sonication to supernatant fluid removal is repeated three times. Next, the toner particles are dissolved in a toluene solution, and the binder resin and the release agent, which are the principal components, are removed by preparative HPLC (LC-9101, manufactured by Japan Analytical Industry Co., Ltd.) to separate the toner particles and the hybrid resin including the crystalline aliphatic polyester resin from each other. The resulting separated solution including the hybrid resin is dried.

(2) Pyrolysis-Gas Chromatography-Mass Spectrometry of Crystalline Aliphatic Polyester Resin The conditions, such as apparatuses, of pyrolysis-gas chromatography-mass spectrometry are as follows.

Apparatus system: py2020iD (pyrolysis unit) manufactured by Frontier Laboratories Ltd., Shimadzu GC17A-QP5050A system Pyrolytic furnace temperature: 600° C., GC-side interface temperature: 310° C.

Carrier gas: He gas (99.99995% pure)

Column: Ultra Alloy (UA±5)

Column length: 30 m (inner diameter=0.25 mm)

Thickness: 0.25 μm (5% Diphenyldimethyl polysiloxane treatment)

INJ temperature: 310° C., DET temperature: 313° C.

Column compartment temperature: start at 50° C. and maintain for 3 minutes, then raise to 310° C. at 10° C./min and maintain for 31 minutes Helium flow rate conditions: 80 kPa constant pressure control, 20 mL/min split MS detection: 0.8 to 60 min range Ionization source: EI, filament voltage: 1.20 kV Detection: M/z 29 to 600

Measurement time: 60 min

Library: NIST library for Class-5000

Under the above measurement conditions, 0.5 mg of an analyte material is placed in an inactivated measuring cup (Eco-cup L (0.08 mL) available from Frontier Laboratories Ltd.) and analyzed.

(3) Analysis of Number of Carbon Atoms of Hybrid Resin Sample

The attribution of the peaks obtained by the above pyrolysis-gas chromatography-mass spectrometry is performed, and the number of carbon atoms is determined from the attribution results of aliphatic hydrocarbons, aliphatic alcohols, and aliphatic carboxylic acids.

Other analysis methods, as well as the above-described analysis method, may be used if they are able to determine the number of carbon atoms of the crystalline aliphatic polyester resin.

The crystalline polyester resin preferably has a melting temperature of 50° C. or higher and 100° C. or lower, more preferably 55° C. or higher and 90° C. or lower, still more preferably 60° C. or higher and 85° C. or lower.

The melting temperature is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

The crystalline polyester resin preferably has a weight-average molecular weight (Mw) of 6,000 or more and 35,000 or less.

The crystalline polyester resin may be produced, for example, by a known process, as with the amorphous resin described below.

(B) Amorphous Resin Unit Other Than Polyester Resins

The amorphous resin unit other than polyester resins will now be described.

Examples of amorphous resins that form the amorphous resin unit (hereinafter also referred to simply as "amorphous resins") include known amorphous resins such as amorphous vinyl resins (e.g., polystyrene resins and styrene-(meth)acrylic resins), epoxy resins, polycarbonate resins, and polyurethane resins.

Of these, the amorphous resin preferably includes a polystyrene resin, more preferably further includes a polyurethane resin, in order to provide low-temperature fixability and suppress the occurrence of filming after storage of toner at high temperature. The amorphous resin for use may be a commercially available product or may be synthesized.

Examples of polystyrene resins include (co)polymers of styrene and (co)polymers of styrene derivatives. Examples of styrene derivatives include alkyl-substituted styrenes having alkyl chains, such as α-methylstyrene, 4-methylstyrene, 2-methylstyrene, 3-methylstyrene, 2-ethylstyrene, 3-ethylstyrene, and 4-ethylstyrene; halogen-substituted styrenes such as 2-chlorostyrene, 3-chlorostyrene, and 4-chlorostyrene; fluorine-substituted styrenes such as 4-fluorostyrene and 2,5-difluorostyrene; and vinylnaphthalene.

Examples of polyurethane resins include polyurethane resins obtained by the reaction between resins having an OH group (at least one selected from the group consisting of polyvinyl acetal resins, polyvinyl resins, casein, phenol resins, and other resins) and isocyanate compounds (e.g., aromatic polyisocyanate, aliphatic polyisocyanate, and alicyclic polyisocyanate).

The isocyanate compound may be a blocked isocyanate compound (a compound having an isocyanate group protected by a blocking agent).

The amorphous resin preferably has a glass transition temperature (Tg) of 50° C. or higher and 80° C. or lower, more preferably 50° C. or higher and 65° C. or lower.

The glass transition temperature is determined from a DSC curve obtained by differential scanning calorimetry (DSC). More specifically, the glass transition temperature is determined in accordance with "Extrapolation Glass Transition Onset Temperature" described in Determination of Glass Transition Temperature in JIS K 7121-1987 "Testing Methods for Transition Temperatures of Plastics".

The amorphous resin preferably has a weight-average molecular weight (Mw) of 5,000 or more and 1,000,000 or less, more preferably 7,000 or more and 500,000 or less.

The amorphous resin preferably has a number-average molecular weight (Mn) of 2,000 or more and 100,000 or less.

The amorphous polyester resin preferably has a molecular weight distribution (Mw/Mn) of 1.5 or more and 100 or less, more preferably 2 or more and 60 or less.

The weight-average molecular weight and the number-average molecular weight are determined by gel permeation chromatography (GPC). The molecular weight determination by GPC is performed using a Tosoh HLC-8120GPC system as a measurement apparatus, a Tosoh TSKgel SuperHM-M column (15 cm), and a THF solvent. The weight-average molecular weight and the number-average molecular weight are determined using a molecular weight calibration curve prepared from the measurement results relative to monodisperse polystyrene standards.

The amorphous resin may be produced by a known process. Specifically, the amorphous resin may be produced, for example, by performing a polymerization reaction at a temperature of 180° C. to 230° C., optionally while removing water and alcohol produced during condensation by reducing the pressure in the reaction system.

If any starting monomer is insoluble or incompatible at the reaction temperature, it may be dissolved by adding a high-boiling solvent as a solubilizer. In this case, the polycondensation reaction is performed while distilling off the solubilizer. If the copolymerization reaction is performed using a poorly compatible monomer, the poorly compatible monomer may be condensed with an acid or alcohol to be polycondensed with the monomer before being polycondensed with the major components.

Method for Synthesizing Hybrid Resin

The hybrid resin may be any polymer having a structure in which a crystalline polyester resin unit and an amorphous resin unit are chemically bound together. The hybrid resin for use may be a commercially available product or may be synthesized. Examples of specific methods of synthesizing the hybrid resin include the following methods.

(1) Synthesizing a hybrid resin by prepolymerizing an amorphous resin unit and performing a polymerization reaction for forming a crystalline polyester resin unit in the presence of the amorphous resin unit In this method, the above-described monomer that will constitute an amorphous resin unit is first polymerized to form the amorphous resin unit. Next, a polycarboxylic acid and a polyhydric alcohol are polymerized in the presence of the amorphous resin unit to form a crystalline polyester resin unit. In this polymerization reaction, while the polycarboxylic acid and the polyhydric alcohol are condensed, the polycarboxylic acid or the polyhydric alcohol is added to the amorphous resin unit to thereby synthesize a hybrid resin.

In this method, the crystalline polyester resin unit or the amorphous resin unit may have a site where the units react with each other. Specifically, when the amorphous resin unit is formed, a compound having a site that reacts with a carboxy group or hydroxyl group remaining in the crystalline polyester resin unit and a site that reacts with the amorphous resin unit may be used in addition to the monomer that will constitute the amorphous resin unit. That is, this compound reacts with the carboxy group or hydroxyl group in the crystalline polyester resin unit, and as a result, the crystalline polyester resin unit is chemically bound to the amorphous resin unit.

By using this method, a hybrid resin having a structure in which the crystalline polyester resin unit is chemically bound to the amorphous resin unit is synthesized.

(2) Synthesizing a hybrid resin by separately forming a crystalline polyester resin unit and an amorphous resin unit and binding the units together In this method, a polycarboxylic acid and a polyhydric alcohol are first condensed to form a crystalline polyester resin unit. Separately from the reaction system to form the crystalline polyester resin unit, the above-described monomer that will constitute an amorphous resin unit is polymerized to form the amorphous resin unit. The crystalline polyester resin unit or the amorphous resin unit may have a site where the units react with each other. The site where the units react with each other may be incorporated by the same method as described in (1).

The crystalline polyester unit and the amorphous resin unit formed above are then reacted with each other to synthesize a hybrid resin having a structure in which the crystalline polyester resin unit and the amorphous resin unit are chemically bound together.

If neither the crystalline polyester resin unit nor the amorphous resin unit has a site where the units react with each other, the following method may be used: a system in which the crystalline polyester resin unit and the amorphous resin unit coexist is formed; a compound having a site to which the crystalline polyester resin unit and the amorphous resin unit bind is introduced into the system; and the crystalline polyester resin unit and the amorphous resin unit are chemically bound together through the compound to synthesize a hybrid resin.

(3) Synthesizing a hybrid resin by preforming a crystalline polyester resin unit and performing a polymerization reaction for forming an amorphous resin unit in the presence of the crystalline polyester resin unit In this method, a polycarboxylic acid and a polyhydric alcohol are first polycondensed to form a crystalline polyester resin unit. Next, a monomer that will constitute an amorphous resin unit is polymerized in the presence of the crystalline polyester resin unit to form the amorphous resin unit. As in the above method (1), the crystalline polyester resin unit or the amorphous resin unit may have a site where the units react with each other. The site where the units react with each other may be incorporated by the same method as described in (1).

By using this method, a hybrid resin having a structure in which the amorphous resin unit is chemically bound to the crystalline polyester resin unit is formed.

To provide a hybrid resin with sufficient crystallinity, the content of the crystalline polyester resin unit in the hybrid resin is preferably 50% by mass or more and 98% by mass or less.

To provide low-temperature fixability and suppress the occurrence of filming after storage of toner at high temperature, the content of the hybrid resin relative to the content of the release agent is preferably 50% by mass or more and 300% by mass or less, more preferably 60% by mass or more and 280% by mass or less, still more preferably 70% by mass or more and 260% by mass or less.

To provide low-temperature fixability and suppress the occurrence of filming after storage of toner at high temperature, the content of the hybrid resin in the binder resin is preferably 5% by mass or more and less than 40% by mass, more preferably 10% by mass or more and less than 30% by mass, still more preferably 15% by mass or more and less than 20% by mass.

To provide a toner with low-temperature fixability, the hybrid resin preferably has a weight-average molecular weight (Mw) of 5,000 or more and 100,000 or less, more preferably 7,000 or more and 50,000 or less, still more preferably 8,000 or more and 20,000 or less.

The hybrid resin preferably has a molecular weight distribution (Mw/Mn) of 1.5 or more and 100 or less, more preferably 2 or more and 60 or less.

The weight-average molecular weight and the number-average molecular weight are determined by gel permeation chromatography (GPC). The molecular weight determination by GPC is performed using a Tosoh HLC-8120GPC system as a measurement apparatus, a Tosoh TSKgel SuperHM-M column (15 cm), and a THF solvent. The weight-average molecular weight and the number-average molecular weight are determined using a molecular weight calibration curve prepared from the measurement results relative to monodisperse polystyrene standards.

"Crystalline" in the context of a resin means that the resin shows a distinct endothermic peak, rather than a stepwise change in the amount of heat absorbed, in differential scanning calorimetry (DSC). Specifically, it means that the half-width of the endothermic peak measured at a heating rate of 10° C./min is within 10° C.

"Amorphous" in the context of a resin means that the half-width exceeds 10° C., that a stepwise change in the amount of heat absorbed is shown, or that no distinct endothermic peak is observed.

The hybrid resin preferably has a melting temperature of 40° C. or higher and 80° C. or lower, more preferably 50° C. or higher and 70° C. or lower.

The melting temperature of the hybrid resin is determined from a DSC curve obtained by differential scanning calorimetry (DSC) in accordance with "Melting Peak Temperature" described in Determination of Melting Temperature of JIS K 7121-1987 "Testing Methods for Transition Temperatures of Plastics".

Vinyl Resin

A description will now be given of vinyl resins.

The binder resin according to the exemplary embodiment includes a vinyl resin.

The vinyl resin refers to a resin obtained by radical polymerization of a monomer having a vinyl group (hereinafter referred to as a "vinyl monomer"). The vinyl resin may be a homopolymer obtained by polymerization of one vinyl monomer or a copolymer obtained by polymerization of two or more vinyl monomers.

Examples of vinyl resins include homopolymers of monomers such as monomers having a styrene backbone (e.g., styrene, p-chlorostyrene, and α-methylstyrene), monomers having a (meth)acrylate backbone (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), monomers having an ethylenically unsaturated nitrile backbone (e.g., acrylonitrile and methacrylonitrile), monomers having a vinyl ether backbone (e.g., vinyl methyl ether and vinyl isobutyl ether), monomers having a vinyl ketone backbone (e.g., vinyl methyl ketone, vinyl ethyl ketone, and vinyl isopropenyl ketone), and monomers having an olefin backbone (e.g., ethylene, propylene, and butadiene); and copolymers of two or more of these monomers.

Of these, the vinyl resin is preferably a styrene-(meth) acrylic resin obtained by copolymerization of a monomer having a styrene backbone and a monomer having a (meth) acrylate backbone, in order to provide low-temperature fixability.

The styrene-(meth)acrylic resin is a copolymer obtained by copolymerization of at least a monomer having a styrene backbone and a monomer having a (meth)acryloyl group. The expression "(meth)acrylic acid" encompasses both "acrylic acid" and "methacrylic acid". The expression "(meth)acryloyl group" encompasses both "acryloyl group" and "methacryloyl group".

Examples of monomers having a styrene backbone (hereinafter referred to as "styrene monomers") include styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), halogen-substituted styrenes (e.g., 2-chlorostyrene, 3-chlorostyrene, and 4-chlorostyrene), and vinylnaphthalene. These styrene monomers may be used alone or in combination.

Of these styrene monomers, styrene is preferred for its ease of reaction, ease of reaction control, and availability.

Examples of monomers having a (meth)acryloyl group (hereinafter referred to as "(meth)acrylic monomers") include (meth)acrylic acid and (meth)acrylates. Examples of (meth)acrylates include alkyl (meth)acrylates (e.g., n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), aryl (meth)acrylates (e.g., phenyl (meth)acrylate, biphenyl (meth)acrylate, diphenylethyl (meth)acrylate, t-butylphenyl (meth)acrylate, and terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamides. These (meth) acrylate monomers may be used alone or in combination.

The ratio (by mass) of the styrene monomer to the (meth)acrylic monomer (styrene monomer/(meth)acrylic monomer) for copolymerization may be, for example, from 85/15 to 70/30.

To suppress the offsetting of images, the styrene-(meth) acrylic resin may have a cross-linked structure. Examples of such a styrene-(meth)acrylic resin having a cross-linked structure include cross-linked copolymers of at least a monomer having a styrene backbone, a monomer having a (meth)acrylate backbone, and a crosslinkable monomer.

Examples of crosslinkable monomers include bi- or more functional cross-linking agents.

Examples of bifunctional cross-linking agents include divinylbenzene, divinylnaphthalene, di(meth)acrylate compounds (e.g., diethylene glycol di(meth)acrylate, methylenebis(meth)acrylamide, decanediol diacrylate, and glycidyl (meth)acrylate), polyester di(meth)acrylates, and 2-([1'-methylpropylideneamino]carboxyamino)ethyl (meth)acrylate.

Examples of polyfunctional cross-linking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., tetramethylolmethane tetra(meth)acrylate and oligoester (meth)acrylates), 2,2-bis(4-methacryloxypolyethoxyphenyl)propane, diallyl phthalate, triallyl cyanurate, triallyl isocyanurate, triallyl trimellitate, and diallyl chlorendate.

The ratio (by mass) of the crosslinkable monomer to all monomers (crosslinkable monomer/all monomers) for copolymerization may be, for example, 2/1,000 to 30/1,000.

To suppress the offsetting of images, the weight-average molecular weight of the styrene-(meth)acrylic resin may be, for example, 30,000 or more and 200,000 or less, preferably 40,000 or more and 100,000 or less, more preferably 50,000 or more and 80,000 or less.

The weight-average molecular weight of the styrene-(meth)acrylic resin is determined by the same method as the weight-average molecular weight of the polyester resin.

The content of the styrene-(meth)acrylic resin in the vinyl resin is preferably 90% by mass or more and 100% by mass or less, more preferably 98% by mass or more and 100% by mass or less.

The content of the vinyl resin in the binder resin may be, for example, 10% by mass or more and 30% by mass or less, preferably 12% by mass or more and 28% by mass or less, more preferably 15% by mass or more and 25% by mass or less.

Release Agent

A description will now be given of release agents.

The toner particles according to the exemplary embodiment contain a release agent including a hydrocarbon wax.

Specific examples of hydrocarbon waxes include polyethylene wax, polypropylene wax, polyolefin wax, Fischer-Tropsch wax, paraffin wax, and microcrystalline wax.

The hydrocarbon wax for use may be a commercially available product. Examples of commercially available products include HNP9 (available from Nippon Seiro Co., Ltd.), PW725 (available from Toyo Petrolite Co., Ltd.), FNP90 (available from Nippon Seiro Co., Ltd.), FNP80 (available from Nippon Seiro Co., Ltd.), and FT105 (available from Nippon Seiro Co., Ltd).

The number of carbon atoms (Cwax) of the hydrocarbon wax is preferably 35 or more and 70 or less, more preferably 35 or more and 65 or less, still more preferably 45 or more and 60 or less.

Examples of hydrocarbon waxes whose number of carbon atoms (Cwax) is 35 or more and 70 or less include HNP9 (available from Nippon Seiro Co., Ltd.), PW725 (available from Toyo Petrolite Co., Ltd.), and FNP90 (available from Nippon Seiro Co., Ltd).

Examples of release agents other than hydrocarbon waxes include natural waxes such as carnauba wax, rice wax, and Candelilla wax; synthetic, mineral, and petroleum waxes such as montan wax; and ester waxes such as fatty acid esters and montanic acid esters, but are not limited thereto. These release agents may be used alone or in combination.

When a plurality of hydrocarbon waxes are used, the weighted average resulting from the multiplication by the molar ratio of each hydrocarbon wax obtained by gas chromatography of the release agent separated from the toner particles is used as the number of carbon atoms of the polycarboxylic acid component.

Ccry/Cwax, i.e., the ratio of Ccry, which is the total number of carbon atoms of the polycarboxylic acid component and the polyhydric alcohol component that form the crystalline aliphatic polyester resin of the hybrid resin, to Cwax, which is the number of carbon atoms of the hydrocarbon wax, preferably satisfies $0.25<Ccry/Cwax<0.5$, more preferably satisfies $0.27<Ccry/Cwax<0.45$, still more preferably satisfies $0.3<Ccry/Cwax<0.4$.

If Ccry/Cwax is more than 0.25 or less than 0.5, i.e., Ccry, which is the total number of carbon atoms of the polycarboxylic acid component and the polyhydric alcohol component that form the crystalline aliphatic polyester resin of the hybrid resin, and Cwax, which is the number of carbon atoms of the hydrocarbon wax, are close to each other, the affinity of the release agent for the hybrid resin tends to be higher. Thus, the release agent will probably more efficiently suppress the movement of the hybrid resin to the toner particle surface. As a result, the occurrence of filming after storage of toner at high temperature tends to be suppressed.

The release agent preferably has a melting temperature of 60° C. or higher and 115° C. or lower, more preferably 70° C. or higher and 105° C. or lower.

The difference in melting temperature between the release agent and the hybrid resin is preferably 40° C. or less, more preferably 30° C. or less, still more preferably 20° C. or less, particularly preferably 0° C.

The melting temperature is determined in the same manner as the melting temperature of the hybrid resin.

The content of the hydrocarbon wax in the entire release agent is preferably 90% by mass or more and 100% by mass or less, more preferably 98% by mass or more and 100% by mass or less.

To provide low-temperature fixability and suppress the occurrence of filming after storage of toner at high temperature, the content of the release agent in the toner particles is preferably 3% by mass or more and less than 30% by mass, more preferably 5% by mass or more and 9% by mass or less, still more preferably 6% by mass or more and 8% by mass or less.

(1) Separation of Release Agent

The external additive is separated from the toner by the following procedure. The toner is placed into a 5% aqueous solution of a surfactant (e.g., sodium alkylbenzene sulfonate) serving as a dispersant and blended by stirring. The resulting solution is then sonicated with a bath-type sonicator to separate the external additive from the surface of the toner particles. Thereafter, the toner components are allowed to settle by centrifugation. The supernatant fluid in which the separated external additive is dispersed is removed. This procedure from sonication to supernatant fluid removal is repeated three times. Next, the toner particles are dissolved in a toluene solution, and the binder resin and the hybrid resin, which are the principal components, are removed by preparative HPLC (LC-9101, manufactured by Japan Analytical Industry Co., Ltd.) to separate the release agent from the toner. The resulting solution is dried to obtain a release agent sample.

(2) Gas Chromatography of Release Agent

The release agent sample separated from the toner is accurately weighed to 10 mg and placed in a pressure-resistant sample tube. To the pressure-resistant sample tube, 10 g of hexane is added. After being capped, the sample tube is heated to 150° C. using a hot plate and stirred to dissolve the release agent sample into the hexane solvent. Thereafter, the pressure-resistant sample tube is uncapped. Before the hexane solvent is evaporated to precipitate the release agent sample, 20 mL of the sample is withdrawn with a gas-tight syringe and subjected to gas chromatography under the following conditions.

Column: Ultra ALLOY-1, P/N: UA1-30M-0.5F (manufactured by Frontier Laboratories Ltd.)

Carrier gas: helium gas

Oven: (1) maintain at 100° C. for 5 minutes (2) raise to 360° C. at 30° C./min (3) maintain at 360° C. for 60 minutes Inlet: 300° C.

Initial pressure: 10.523 psi

Split ratio: 50:1

Column flow rate: 1 mL/min (3) Determination of Number of Carbon Atoms of Release Agent Sample Next, the number of carbon atoms of the hydrocarbon wax is determined from the peak molecular weight and the peak area of the hydrocarbon wax obtained by the above measurement. For example, when a polyethylene sample is used and determined to have a weight-average molecular weight of 14,000, the number of carbon atoms is 1,000 since the molecular weight of $CH_2$, which is the structural unit of polyethylene, is 14.

Hereinafter, how to determine the number of carbon atoms when the release agent includes a plurality of hydrocarbon waxes will be described.

The area fraction (%) of a peak area of each component in the release agent in the total peak area of all the detected components in the release agent, i.e., (peak area of each hydrocarbon wax in release agent/total peak area of all detected hydrocarbon waxes in release agent)×100 is calculated. The area fraction obtained is the presence rate (area fraction) of each hydrocarbon wax in the release agent.

The area fraction ratio of the detected components is then determined. For example, when a component A and a component B are contained as hydrocarbon waxes, the area ratio of the component A is equal to component A/(component A+component B). Using the area ratio of each hydrocarbon wax component, the weighted average is calculated to determine the number of carbon atoms of the hydrocarbon waxes in the release agent.

External Additive

A description will now be given of external additives.

The toner according to the exemplary embodiment includes an external additive.

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

The surface of inorganic particles used as an external additive may be subjected to hydrophobic treatment. The hydrophobic treatment may be performed, for example, by immersing the inorganic particles in a hydrophobic agent. Non-limiting examples of hydrophobic agents include silane coupling agents, silicone oil, titanate coupling agents, and aluminum coupling agents. These hydrophobic agents may be used alone or in combination.

The amount of hydrophobic agent is typically, for example, 1 part by mass or more and 10 parts by mass or less relative to 100 parts by mass of the inorganic particles.

Examples of resin particles used as external additives include particles of resins such as polystyrene, polymethyl methacrylate (PMMA), and melamine resins.

Examples of cleaning active agents used as external additives include particles of higher fatty acid metal salts such as zinc stearate and particles of fluoropolymers.

For example, the amount of external additive added is preferably 0.01% by mass or more and 5% by mass or less, more preferably 0.01% by mass or more and 2.0% by mass or less, relative to the amount of toner particles.

Method for Producing Toner

The toner according to the exemplary embodiment is produced, for example, by producing toner particles and adding an external additive to the toner particles.

The toner particles may be produced by a dry process (e.g., kneading pulverization) or a wet process (e.g., aggregation coalescence, suspension polymerization, or dissolution suspension). Not only these processes but any known process may be used. In particular, the toner particles are preferably produced by aggregation coalescence.

Specifically, for example, when the toner particles are produced by aggregation coalescence, they are produced by the steps of:

providing a hybrid resin particle dispersion in which hybrid resin particles are dispersed (hybrid resin particle dispersion providing step);

providing a vinyl resin particle dispersion in which vinyl resin particles are dispersed (vinyl resin particle dispersion providing step);

providing a release agent particle dispersion in which release agent particles are dispersed (release agent particle dispersion providing step);

mixing the hybrid resin particle dispersion and the vinyl resin particle dispersion (and optionally other particle dispersions such as colorant particle dispersions) and aggregating the mixed particles in the mixed dispersion to form first aggregated particles (first aggregated particle forming step);

mixing the first aggregated particle dispersion, in which the first aggregated particles are dispersed, with the vinyl resin particle dispersion and the release agent particle dispersion to form second aggregated particles (second aggregated particle forming step); and heating the second aggregated particle dispersion, in which the second aggregated particles are dispersed, to fuse and coalesce the second aggregated particles, thereby forming toner particles (fusion and coalescence step).

The steps of the aggregation coalescence process will now be described in detail. Although a method for producing toner particles including a colorant will be described below, the colorant is optional. It should be understood that additives other than colorants may also be used.

Dispersion Providing Steps

First, a resin particle dispersion in which hybrid resin particles are dispersed, a vinyl resin particle dispersion in which vinyl resin particles are dispersed, a colorant dispersion in which colorant particles are dispersed, and a release agent particle dispersion in which release agent particles are dispersed are provided.

The hybrid resin particle dispersion is prepared, for example, by dispersing hybrid resin particles in a dispersion medium with a surfactant.

Examples of dispersion media used to prepare the hybrid resin particle dispersion include aqueous media.

Examples of aqueous media include water such as distilled water and ion-exchanged water and alcohols. These aqueous media may be used alone or in combination.

Examples of surfactants include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. Of these, anionic surfactants and cationic surfactants are particularly preferred. Nonionic surfactants may be used in combination with an anion surfactant or a cation surfactant.

These surfactants may be used alone or in combination.

The hybrid resin particles may be dispersed in the dispersion medium, for example, by common dispersion processes using machines such as rotary shear homogenizers and media mills such as ball mills, sand mills, and Dyno-Mills. Alternatively, the hybrid resin particles may be dispersed in the dispersion medium by phase-inversion emulsification. Phase-inversion emulsification is a process involving dissolving a resin of interest in a hydrophobic organic solvent capable of dissolving the resin, neutralizing the organic continuous phase (O-phase) by adding a base thereto, and then adding water (W-phase) to cause phase inversion from W/O to O/W, thereby dispersing the resin in the form of particles in the aqueous medium.

The vinyl resin particle dispersion, the colorant dispersion, and the release agent particle dispersion are prepared in the same manner as the hybrid resin particle dispersion. That is, the dispersion medium, dispersion process, volume-average particle size, and particle content of the vinyl resin particle dispersion, the colorant dispersion, and the release agent particle dispersion are the same as those of the hybrid resin particle dispersion.

First Aggregated Particle Forming Step

In the first aggregated particle forming step, the hybrid resin particle dispersion, the vinyl resin particle dispersion, and the colorant dispersion are mixed together.

The hybrid resin particles, the vinyl resin particles, and the colorant particles are then allowed to undergo hetero-aggregation in the mixed dispersion to form first aggregated particles including the hybrid resin particles, the vinyl resin particles, and the colorant particles. The first aggregated particles have a particle size close to that of the desired toner particles.

Specifically, the first aggregated particles are formed, for example, by adding a coagulant to the mixed dispersion while adjusting the mixed dispersion to an acidic pH (e.g., a pH of 2 to 5), optionally adding a dispersion stabilizer, and then heating the mixed dispersion to aggregate the particles dispersed therein. The mixed dispersion is heated to a temperature close to the glass transition temperature of the vinyl resin particles (e.g., 10° C. to 30° C. lower than the glass transition temperature of the vinyl resin particles).

For example, the first aggregated particle forming step may be performed by adding a coagulant to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and then heating the mixed dispersion.

Examples of coagulants include surfactants of opposite polarity to that of the surfactant present in the mixed dispersion, inorganic metal salts, and metal complexes with a valence of two or more. The use of a metal complex as the coagulant may reduce the amount of coagulant used, which may improve the charging characteristics.

The coagulant may be used in combination with additives that form a complex or a similar linkage together with metal ions of the coagulant. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

For example, the chelating agent is added preferably in an amount of 0.01 parts by mass or more and 5.0 parts by mass or less, more preferably 0.1 parts by mass or more and less than 3.0 parts by mass, relative to 100 parts by mass of the vinyl resin particles.

The first aggregated particles dispersed in the first aggregated particle dispersion preferably have a volume-average particle size of, for example, 2.0 μm or more and 4.0 μm or less, more preferably 3.0 μm or more and 4.0 μm or less, still more preferably 3.5 μm or more and 4.0 μm or less.

The volume-average particle size of the first aggregated particles is determined as follows. A particle size distribution is obtained using a laser diffraction particle size distribution analyzer (e.g., LA-700, manufactured by Horiba, Ltd.) and is divided into particle size classes (channels). A cumulative volume distribution is drawn from smaller particle sizes. The volume-average particle size D50v is defined as the particle size at which the cumulative volume is 50% of all particles. The volume-average particle sizes of particles in other dispersions are also determined in the same manner.

Second Aggregated Particle Forming Step

When the volume-average particle size of the first aggregated particles dispersed in the first aggregated particle dispersion reaches the above-described preferred range of the volume-average particle size in the first aggregated particle forming step, the vinyl resin particle dispersion and the release agent particle dispersion are further mixed with the total amount of the first aggregated particle dispersion. The vinyl resin particle dispersion and the release agent particle dispersion may be mixed with the first aggregated particle dispersion in any order and by any method. They may be mixed in a stepwise manner as appropriate, depending on the desired Lhyb and Lwax. For example, a mixed dispersion of the vinyl resin particle dispersion and the release agent particle dispersion may be prepared in advance and then mixed with the first aggregated particle dispersion.

The resulting mixed dispersion is then heated at or below the glass transition temperature of the vinyl resin, and the pH of the mixed dispersion is adjusted to, for example, about 6.5 to 8.5. In this manner, the second aggregated particle dispersion in which the second aggregated particles are dispersed is obtained.

The second aggregated particles dispersed in the second aggregated particle dispersion preferably have a volume-average particle size of, for example, 3.0 μm or more and 8.0 μm or less, more preferably 3.5 μm or more and 7.0 μm or less, still more preferably 4.0 μm or more and 6.0 μm or less.

The volume-average particle size of the second aggregated particles is determined in the same manner as the volume-average particle size of the first aggregated particles.

If the release agent particle dispersion is mixed in the second aggregated particle forming step, release agent domains tend to be distributed in the vicinity of the surface of toner particles. That is, hybrid resin domains are less likely to move to the surface of the toner particles. As a result, the occurrence of filming after storage of toner at high temperature tends to be suppressed.

A step of forming third aggregated particles by further mixing a vinyl resin dispersion may optionally be performed between the second aggregated particle forming step and the fusion and coalescence step. The step of forming third aggregated particles may be performed according to the same procedure as in the second aggregated particle forming step.

Fusion and Coalescence Step

Next, the second aggregated particle dispersion in which the second aggregated particles are dispersed is heated, for example, at or above the glass transition temperature of the vinyl resin (e.g., 10° C., to 50° C. higher than the glass transition temperature of the vinyl resin) to fuse and coalesce the second aggregated particles, thereby forming toner particles.

Although the toner particles are obtained by the above process, any formulation other than the above-described formulations may be used in the aggregated particle forming steps.

After the fusion and coalescence step, the toner particles formed in the dispersion are subjected to known washing, solid-liquid separating, and drying steps to obtain dry toner particles.

In the washing step, the toner particles may be sufficiently washed by displacement washing with ion-exchanged water in terms of charging characteristics. Although the solid-liquid separating step may be performed by any process, processes such as suction filtration and pressure filtration may be used in terms of productivity. Although the drying step may be performed by any process, processes such as freeze drying, flush jet drying, fluidized bed drying, and vibrating fluidized bed drying may be used in terms of productivity.

The toner according to the exemplary embodiment is produced, for example, by adding an external additive to the dry toner particles and mixing them together. The mixing may be performed, for example, with a V-blender, a Henschel mixer, or a Loedige mixer. Optionally, coarse toner particles may be removed using, for example, a vibrating screen or an air screen.

Image Forming Apparatus/Image Forming Method

An image forming apparatus and an image forming method according to an exemplary embodiment will be described.

The image forming apparatus according to the exemplary embodiment includes an image carrier, a charging unit that charges a surface of the image carrier, an electrostatic image forming unit that forms an electrostatic image on the charged surface of the image carrier, a developing unit that contains an electrostatic image developer and develops the electrostatic image formed on the surface of the image carrier with the electrostatic image developer to form a toner image, a transfer unit that transfers the toner image formed on the surface of the image carrier to a surface of a recording medium, and a fixing unit that fixes the toner image transferred to the surface of the recording medium. The electrostatic image developer is an electrostatic image developer according to the exemplary embodiment.

The image forming apparatus according to the exemplary embodiment executes an image forming method (the image forming method according to the exemplary embodiment) including a charging step of charging a surface of an image carrier, an electrostatic image forming step of forming an electrostatic image on the charged surface of the image carrier, a developing step of developing the electrostatic image formed on the surface of the image carrier with the electrostatic image developer according to the exemplary embodiment to form a toner image, a transfer step of transferring the toner image formed on the surface of the image carrier to a surface of a recording medium, and a fixing step of fixing the toner image transferred to the surface of the recording medium.

The image forming apparatus according to the exemplary embodiment may be a known type of image forming apparatus: for example, a direct-transfer apparatus that transfers a toner image formed on a surface of an image carrier directly to a recording medium; an intermediate-transfer apparatus that first transfers a toner image formed on a surface of an image carrier to a surface of an intermediate transfer body and then transfers the toner image transferred to the surface of the intermediate transfer body to a surface of a recording medium; an apparatus including a cleaning unit that cleans a surface of an image carrier after the transfer of a toner image and before charging; or an apparatus including an erasing unit that erases charge on a surface of an image carrier by irradiation with erasing light after the transfer of a toner image and before charging.

When the image forming apparatus according to the exemplary embodiment is an intermediate-transfer apparatus, the transfer unit includes, for example, an intermediate transfer body having a surface to which a toner image is transferred, a first transfer unit that transfers a toner image formed on a surface of an image carrier to the surface of the intermediate transfer body, and a second transfer unit that transfers the toner image transferred to the surface of the intermediate transfer body to a surface of a recording medium.

In the image forming apparatus according to the exemplary embodiment, the section including the developing unit may be, for example, a cartridge structure (process cartridge) attachable to and detachable from the image forming apparatus. The process cartridge may include, for example, a developing unit containing the electrostatic image developer according to the exemplary embodiment.

A non-limiting example of the image forming apparatus according to the exemplary embodiment will now be described. In the following description, the parts illustrated in the drawings are described, and other parts are not described.

Figure 3:
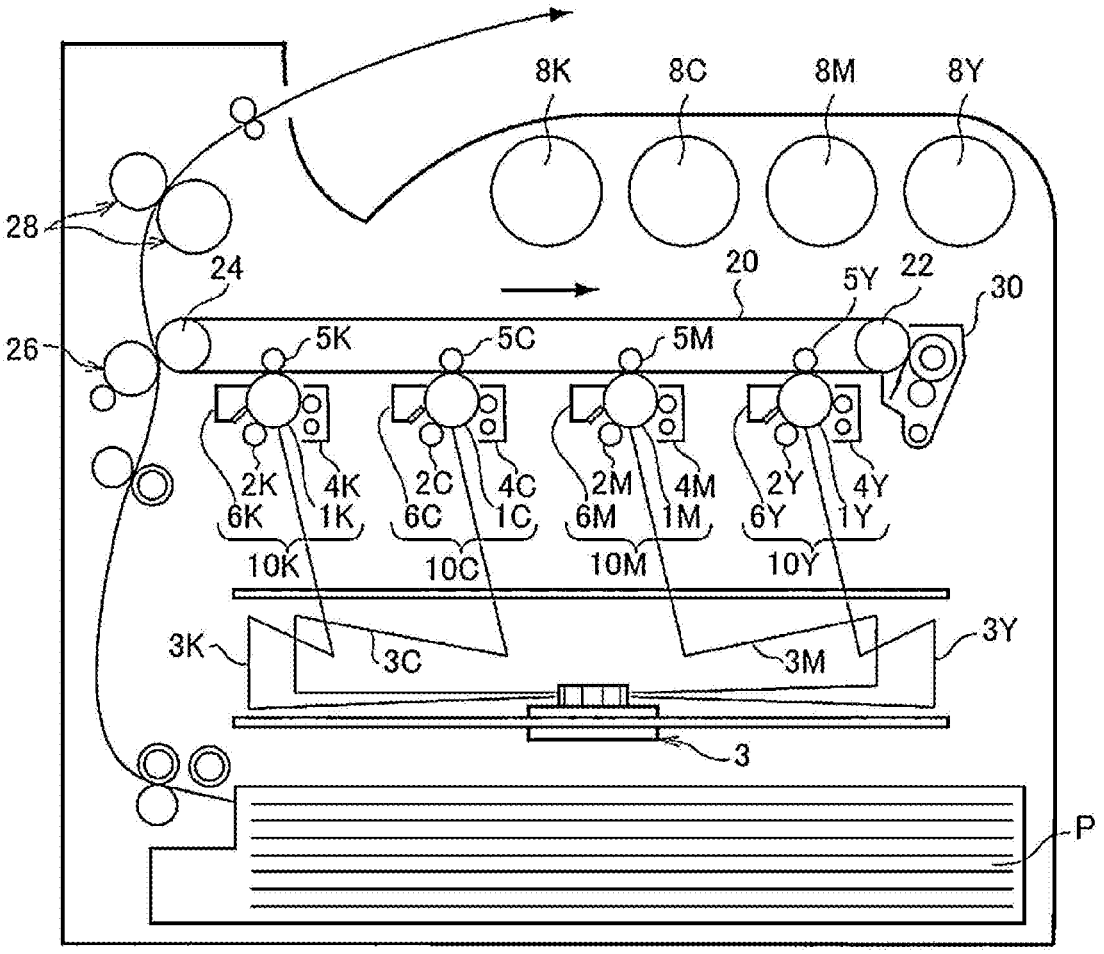
FIG. 3 is a schematic diagram illustrating the configuration of an image forming apparatus according to an exemplary embodiment.

FIG. 3 is a schematic diagram illustrating the configuration of the image forming apparatus according to the exemplary embodiment.

The image forming apparatus shown in FIG. 3 includes first to fourth electrophotographic image forming units 10Y, 10M, 100, and 10K that respectively output yellow (Y), magenta (M), cyan (C), and black (K) images based on color-separated image data. These image forming units (hereinafter also referred to simply as "units") 10Y, 10M, 10C, and 10K are arranged side by side at predetermined intervals in the horizontal direction. The units 10Y, 10M, 10C, and 10K may be process cartridges attachable to and detachable from the image forming apparatus.

An intermediate transfer belt (an example of an intermediate transfer body) 20 extends above the units 10Y, 10M, 10C, and 10K so as to pass through the units. The intermediate transfer belt 20 is wound around a drive roller 22 and a support roller 24, which are in contact with the inner surface of the intermediate transfer belt 20, and is configured to travel in the direction from the first unit 10Y toward the fourth unit 10K. A spring or the like (not shown) applies a force to the support roller 24 in the direction away from the drive roller 22, so that tension is applied to the intermediate transfer belt 20 wound around the rollers 22 and 24. An intermediate transfer body cleaning device 30 is provided on the image carrier side of the intermediate transfer belt 20 so as to face the drive roller 22.

The units 10Y, 10M, 100, and 10K respectively include developing devices (examples of developing units) 4Y, 4M, 4C, and 4K to which yellow, magenta, cyan, and black toners are respectively supplied from toner cartridges 8Y, 8M, 8C, and 8K.

The first to fourth units 10Y, 10M, 100, and 10K have the same structure and function and perform the same operation. Thus, the first unit 10Y, which is disposed upstream in the travel direction of the intermediate transfer belt and forms a yellow image, is described as a representative.

The first unit 10Y includes a photoreceptor 1Y that functions as an image carrier. The photoreceptor 1Y is surrounded by, in sequence, a charging roller (an example of a charging unit) 2Y that charges the surface of the photoreceptor 1Y to a predetermined potential, an exposure device (an example of an electrostatic image forming unit) 3 that exposes the charged surface to a laser beam 3Y based on a color-separated image signal to form an electrostatic image, a developing device (an example of a developing unit) 4Y that supplies a charged toner to the electrostatic image to develop the electrostatic image, a first transfer roller (an example of a first transfer unit) 5Y that transfers the developed toner image to the intermediate transfer belt 20, and a photoreceptor cleaning device (an example of a cleaning unit) 6Y that removes the toner remaining on the surface of the photoreceptor 1Y after the first transfer.

The first transfer roller 5Y is disposed inside the intermediate transfer belt 20 so as to face the photoreceptor 1Y. The first transfer rollers 5Y, 5M, 5C, and 5K of the units are each connected to a bias power supply (not shown) that applies a first transfer bias. The value of transfer bias applied from each bias power supply to each first transfer roller is changed by control of a controller (not shown).

The operation of the first unit 10Y to form a yellow image will now be described.

Prior to the operation, the charging roller 2Y charges the surface of the photoreceptor 1Y to a potential of −600 V to −800 V.

The photoreceptor 1Y is formed of a conductive substrate (having a volume resistivity at 20° C. of, for example, $1\times10^{-6}$ Ωcm or less) and a photosensitive layer disposed on the substrate. The photosensitive layer, which normally has high resistivity (resistivity of common resins), has the property of changing its resistivity in a region irradiated with a laser beam. The exposure device 3 applies the laser beam 3Y to the charged surface of the photoreceptor 1Y on the basis of yellow image data sent from the controller (not shown). As a result, an electrostatic image with a yellow image pattern is formed on the surface of the photoreceptor 1Y.

The electrostatic image is an image formed on the surface of the photoreceptor 1Y by charging. Specifically, the electrostatic image is what is called a negative latent image formed in the following manner: in the portion of the photosensitive layer irradiated with the laser beam 3Y, the resistivity drops, and the charge on the surface of the photoreceptor 1Y dissipates from the region, while the charge remains in the portion not irradiated with the laser beam 3Y.

As the photoreceptor 1Y rotates, the electrostatic image formed on the photoreceptor 1Y is brought to a predetermined development position. At the development position, the electrostatic image on the photoreceptor 1Y is developed and visualized by the developing device 4Y to form a toner image.

The developing device 4Y contains, for example, an electrostatic image developer including at least a yellow toner and a carrier. The yellow toner is frictionally charged as it is stirred inside the developing device 4Y, and thus has a charge with the same polarity (negative) as that of the charge on the photoreceptor 1Y and is held on a developer roller (an example of a developer holding body). As the surface of the photoreceptor 1Y passes through the developing device 4Y, the yellow toner is electrostatically attached to the neutralized latent image portion on the surface of the photoreceptor 1Y to develop the latent image. The photoreceptor 1Y on which the yellow toner image is formed rotates at a predetermined speed to transport the toner image developed on the photoreceptor 1Y to a predetermined first transfer position.

When the yellow toner image on the photoreceptor 1Y is transported to the first transfer position, a first transfer bias is applied to the first transfer roller 5Y, and electrostatic force directed from the photoreceptor 1Y toward the first transfer roller 5Y acts on the toner image to transfer the toner image on the photoreceptor 1Y to the intermediate transfer belt 20. The transfer bias applied has the opposite polarity (positive) to the toner (negative). In the first unit 10Y, the transfer bias is controlled to, for example, +10 μA by the controller (not shown).

The toner remaining on the photoreceptor 1Y is removed by the photoreceptor cleaning device 6Y and recovered.

The first transfer biases applied to the first transfer rollers 5M, 5C, and 5K of the second to fourth units 10M, 100, and 10K are controlled in the same manner as in the first unit.

Thus, the intermediate transfer belt 20 to which the yellow toner image is transferred by the first unit 10Y is sequentially transported through the second to fourth units 10M, 100, and 10K, and as a result, toner images of the respective colors are transferred in a superimposed manner.

The intermediate transfer belt 20, to which the toner images of the four colors are transferred in a superimposed manner through the first to fourth units, travels to a second transfer section including the intermediate transfer belt 20, the support roller 24 in contact with the inner surface of the intermediate transfer belt, and a second transfer roller (an example of a second transfer unit) 26 disposed on the image carrier side of the intermediate transfer belt 20. A sheet of recording paper (an example of a recording medium) P is fed into the nip between the second transfer roller 26 and the intermediate transfer belt 20 at a predetermined timing by a feed mechanism, and a second transfer bias is applied to the support roller 24. The transfer bias applied has the same polarity (negative) as the toner (negative), and electrostatic force directed from the intermediate transfer belt 20 toward the sheet of recording paper P acts on the toner image to transfer the toner image on the intermediate transfer belt 20 to the sheet of recording paper P. The second transfer bias is determined depending on the resistance detected by a resistance detector (not shown) that detects the resistance of the second transfer section, and thus the voltage is controlled.

The sheet of recording paper P is then sent to a pressure-contact part (nip part) between a pair of fixing rollers of a fixing device (an example of a fixing unit) 28, and the toner image is fixed to the sheet of recording paper P, thus forming a fixed image.

Examples of recording paper P to which toner images are transferred include plain paper for use in electrophotographic copiers, printers, and other devices. Examples of recording media other than the recording paper P include OHP sheets.

To further improve the surface smoothness of the fixed image, the surface of the recording paper P may also be smooth. For example, coated paper, i.e., plain paper coated with resin or the like and art paper for printing are suitable for use.

The sheet of recording paper P after completion of the fixing of the color image is conveyed to a discharge unit. Thus, the color image forming operation is complete.

Process Cartridge/Toner Cartridge

A process cartridge according to an exemplary embodiment will be described.

The process cartridge according to the exemplary embodiment includes a developing unit that contains the electrostatic image developer according to the exemplary embodiment and that develops an electrostatic image formed on a surface of an image carrier with the electrostatic image developer to form a toner image. The process cartridge is attachable to and detachable from an image forming apparatus.

The process cartridge according to the exemplary embodiment may have other configurations. For example, the process cartridge according to the exemplary embodiment may include the developing device and optionally at least one other unit selected from an image carrier, a charging unit, an electrostatic image forming unit, and a transfer unit.

A non-limiting example of the process cartridge according to the exemplary embodiment will now be described. In the following description, the parts illustrated in the drawings are described, and other parts are not described.

Figure 4:
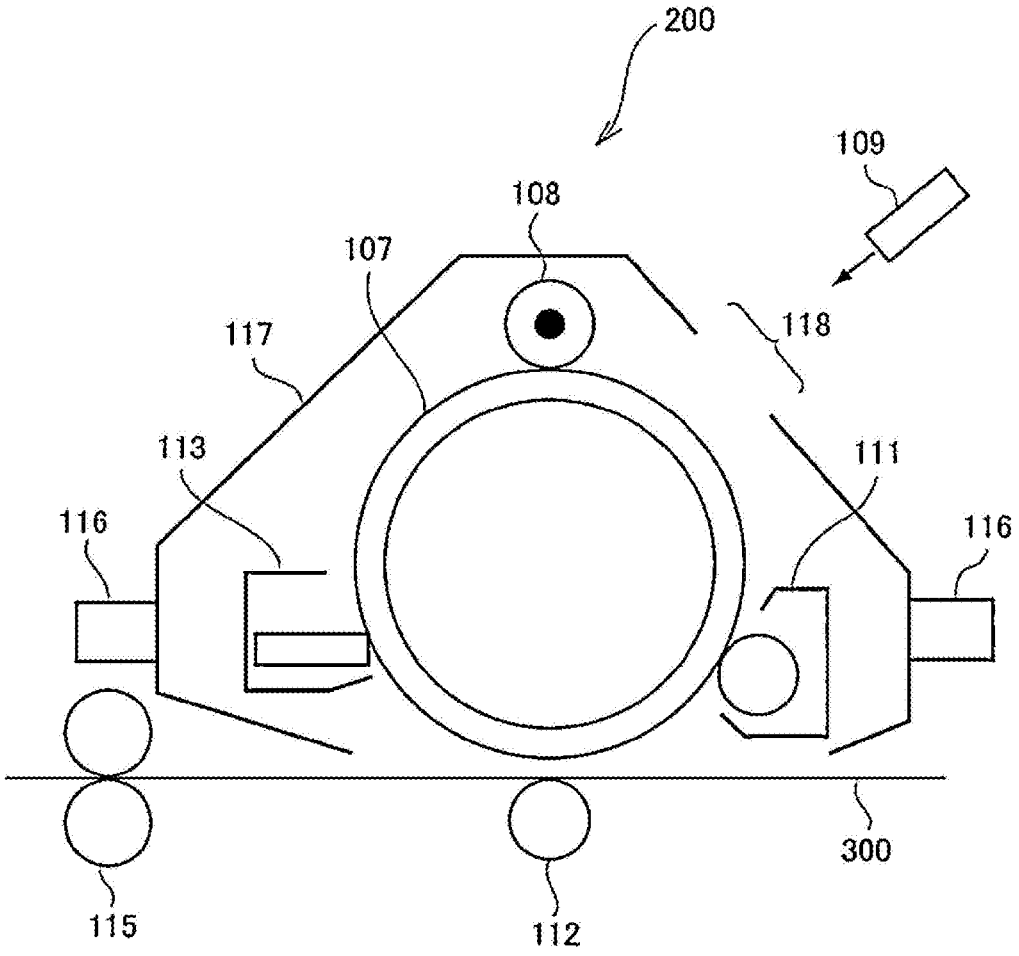
FIG. 4 is a schematic diagram illustrating the configuration of a process cartridge according to an exemplary embodiment.

FIG. 4 is a schematic diagram illustrating the configuration of the process cartridge according to the exemplary embodiment.

A process cartridge 200 shown in FIG. 4 includes, for example, a photoreceptor 107 (an example of an image carrier), a charging roller 108 (an example of a charging unit) disposed on the periphery of the photoreceptor 107, a developing device 111 (an example of a developing unit), and a photoreceptor cleaning device 113 (an example of a cleaning unit) that are assembled into a cartridge with a housing 117 having mounting rails 116 and an opening 118 for exposure.

In FIG. 4, 109 represents an exposure device (an example of an electrostatic image forming unit), 112 represents a transfer device (an example of a transfer unit), 115 represents a fixing device (an example of a fixing unit), and 300 represents a sheet of recording paper (an example of a recording medium).

A toner cartridge according to an exemplary embodiment will now be described.

The toner cartridge according to the exemplary embodiment contains the toner according to the exemplary embodiment and is attachable to and detachable from an image forming apparatus. The toner cartridge contains refill toner to be supplied to a developing unit provided in the image forming apparatus.

The image forming apparatus shown in FIG. 3 is configured such that the toner cartridges 8Y, 8M, 8C, and 8K are attachable thereto and detachable therefrom. The developing devices 4Y, 4M, 4C, and 4K are connected to the toner cartridges corresponding to the colors of the developing devices through toner supply tubes (not shown). The toner cartridges are replaced when the amount of toner therein is decreased.

EXAMPLES

The exemplary embodiments will be described in more detail with reference to the following non-limiting examples. All parts and percentages given in the following description are by mass unless otherwise specified.

Synthesis Examples of Hybrid Resins HB(1) to HB(8)

(1) Synthesis Example of Hybrid Resin HB(1) in Which Amorphous Resin Unit (Polyurethane and Polystyrene Resins) and Crystalline Polyester Resin Unit are Chemically Bound Together Synthesis of Crystalline Polyester Resin Unit In a reaction vessel equipped with a stirrer, a thermometer, a nitrogen inlet tube, and a pressure reducing device, 260 parts by mass of a polyhydric alcohol component (1,6-hexanediol), 460 parts by mass of a polycarboxylic acid component (1,10-decanedicarboxylic acid), and 2 parts by mass of a polymerization catalyst (tin octylate) are placed. The mixture is heated to 180° C. and allowed to react at this temperature under a stream of nitrogen for 10 hours while distilling off the water produced. The reaction is then allowed to proceed in the nitrogen atmosphere for 5 hours while gradually heating the reaction system to 230° C. and distilling off water. Furthermore, the reaction is allowed to proceed under a reduced pressure of 0.007 MPa or more and 0.026 MPa or less while distilling off water. The reaction is stopped when an acid value of 0.1 mgKOH/g is reached to obtain a crystalline polyester diol (crystalline polyester resin unit).

Synthesis of Hybrid Resin by Chemically Binding to Amorphous Resin Unit

A mixture of 14 parts by mass of hexamethylene diisocyanate, 5 parts by mass of butyl acrylate, 4 parts by mass of acrylic acid, 17 parts by mass of styrene, and 5 parts by mass of a polymerization initiator (di-t-butyl peroxide) is introduced into a dropping funnel. The dropping funnel is then mounted to the above reaction vessel, and the mixture is added dropwise over 1 hour while stirring the reaction system (the system containing 360 parts of the crystalline polyester diol) at 160° C. After completion of the addition, the addition polymerization reaction is allowed to continue for 1 hour, while the reaction system is maintained at 160° C. The reaction product is then heated to 200° C. and maintained at 10 kPa for 1 hour, after which residual monomers (acrylic acid, styrene, and butyl acrylate) are removed to obtain a hybrid resin HB(1) in which polyurethane and polystyrene resins (an amorphous resin unit) and a crystalline polyester resin unit are chemically bound together.

Using raw materials in amounts shown in Table 1, hybrid resins HB(2) to HB(6) of other compositions are synthesized in the same manner as the hybrid resin HB(1).

a polymerization initiator (di-t-butyl peroxide) are added and allowed to react at 80° C. for 8 hours, after which methyl ethyl ketone is distilled off to obtain a hybrid resin HB(7) in which a polyurethane resin (amorphous resin unit) and a crystalline polyester resin unit are chemically bound together.

(3) Synthesis Example of Hybrid Resin HB(8) in Which Amorphous Resin Unit (Polystyrene Acrylic Resin) and Crystalline Polyester Resin Unit are Chemically Bound Together Synthesis of Crystalline Polyester Resin Unit A crystalline polyester diol (crystalline polyester resin unit) is obtained in the same manner as HB(1), except that the amounts of the raw materials are as shown in Table 1.

Synthesis of Hybrid Resin by Chemically Binding to Amorphous Resin Unit

A mixture of 5 parts by mass of butyl acrylate, 6 parts by mass of acrylic acid, 17 parts by mass of styrene, and 5 parts by mass of a polymerization initiator (di-t-butyl peroxide) is introduced into a dropping funnel. The dropping funnel is then mounted to the reaction vessel containing the above crystalline polyester resin unit, and the mixture is added dropwise over 1 hour while stirring the reaction system (the system containing 340 parts of the crystalline polyester diol) at 160° C. After completion of the addition, the addition polymerization reaction is allowed to continue for 1 hour, while the reaction system is maintained at 160° C. The reaction product is then heated to 200° C. and maintained at 10 kPa for 1 hour, after which residual monomers (acrylic acid, styrene, and butyl acrylate) are removed to obtain a hybrid resin HB(8) in which a polystyrene-acrylic resin (amorphous resin unit) and a crystalline polyester resin unit are chemically bound together.

TABLE 1

| Type of resin | | | HB1 | HB2 | HB3 | HB4 | H65 | HB6 | HB7 | HB8 |
|---|---|---|---|---|---|---|---|---|---|---|
| Raw materials of crystalline polyester resin unit [parts] | Polyhydric alcohol component | 1,6-hexanediol | 260 | 260 | — | 140 | 260 | 260 | 260 | 240 |
| | | 1,9-nonanediol | — | — | 353 | — | — | — | — | — |
| | | 1,12-dodecanediol | — | — | — | 200 | — | — | — | — |
| | Polycarboxylic acid component | 1,10-decanedicarboxylic acid | 460 | — | 230 | 230 | 460 | 460 | 460 | 440 |
| | | 1,12-dodecanedicarboxylic acid | — | — | 258 | — | — | — | — | — |
| | | fumaric acid | — | 232 | — | 116 | — | — | — | — |
| Raw materials of hybrid resin [parts] | Crystalline polyester resin unit (crystalline polyester diol) | | 360 | 250 | 420 | 340 | 360 | 360 | 360 | 340 |
| | Urethane-group-containing monomer | hexamethylene diisocyanate | 14 | 14 | 14 | 14 | 14 | 14 | 14 | — |
| | Bireactive monomer | acrylic acid | 4 | 4 | 4 | 4 | 4 | 4 | — | 6 |
| | Raw materials of vinyl resin | styrene | 17 | 17 | 17 | 17 | 17 | — | — | 17 |
| | | butyl acrylate | 5 | 5 | 5 | 5 | 5 | 5 | — | 5 |
| | | ethylene | — | — | — | — | — | 9 | — | — |
| Esterification solvent [parts] | | tin octylate | 2 | 2 | 2 | 2 | 2 | 2 | 2 | 2 |
| Polymerization initiator [parts] | | di-t-butyl peroxide | 5 | 5 | 5 | 5 | 5 | 5 | 5 | 5 |

(2) Synthesis Example of Hybrid Resin HB(7) in Which Amorphous Resin Unit (Polyurethane Resin) and Crystalline Polyester Resin Unit are Chemically Bound Together Synthesis of Crystalline Polyester Resin Unit A crystalline polyester diol (crystalline polyester resin unit) is obtained in the same manner as HB(1). Synthesis of Hybrid Resin by Chemically Binding to Amorphous Resin Unit In a reaction vessel equipped with a stirrer, a thermometer, a nitrogen inlet tube, and a pressure reducing device, 360 parts by mass of the above crystalline polyester diol and 400 parts by mass of methyl ethyl ketone are placed and stirred at 60° C. for 1 hour. To the resulting mixture, 14 parts by mass of hexamethylene diisocyanate and 5 parts by mass of Preparation of Dispersions Preparation of Hybrid Resin Particle Dispersion (HYB1)

The hybrid resin HB(1) is dispersed using a CAVITRON CD1010 disperser (manufactured by Eurotec Ltd.) adapted for high-temperature, high-pressure use to obtain a hybrid resin particle dispersion. Specifically, the composition ratio of ion-exchanged water to the hybrid resin is 80:20; the pH is adjusted to 8.5 with ammonia; and the CAVITRON is operated under the following conditions: rotor rotation speed, 60 Hz; pressure, 5 Kg/cm$^2$; heating to 140° C. with heat exchanger.

The hybrid resin particles in the dispersion have a volume-average particle size of 120 nm. The solids content of the hybrid resin particle dispersion is adjusted to 20% by adding ion-exchanged water to the dispersion.

Preparation of Hybrid Resin Particle Dispersion (HYB2)

A hybrid resin particle dispersion (HYB2) is prepared in the same manner as the hybrid resin particle dispersion (HYB1) except that the hybrid resin HB(1) is replaced with HB(2).

The hybrid resin particles in the dispersion have a volume-average particle size of 124 nm. The solids content of the hybrid resin particle dispersion is adjusted to 20% by adding ion-exchanged water to the dispersion.

Preparation of Hybrid Resin Particle Dispersion (HYB3)

A hybrid resin particle dispersion (HYB3) is prepared in the same manner as the hybrid resin particle dispersion (HYB1) except that the hybrid resin HB(1) is replaced with HB(3).

The hybrid resin particles in the dispersion have a volume-average particle size of 121 nm. The solids content of the hybrid resin particle dispersion (HYB3) is adjusted to 20% by adding ion-exchanged water to the dispersion.

Preparation of Hybrid Resin Particle Dispersion (HYB4)

A hybrid resin particle dispersion (HYB4) is prepared in the same manner as the hybrid resin particle dispersion (HYB1) except that the hybrid resin HB(1) is replaced with HB(4).

The hybrid resin particles in the dispersion have a volume-average particle size of 123 nm. The solids content of the hybrid resin particle dispersion (HYB4) is adjusted to 20% by adding ion-exchanged water to the dispersion.

Preparation of Hybrid Resin Particle Dispersion (HYB5)

A hybrid resin particle dispersion (HYB5) is prepared in the same manner as the hybrid resin particle dispersion (HYB1) except that the hybrid resin HB(1) is replaced with HB(5).

The hybrid resin particles in the dispersion have a volume-average particle size of 118 nm. The solids content of the hybrid resin particle dispersion (HYB5) is adjusted to 20% by adding ion-exchanged water to the dispersion.

Preparation of Hybrid Resin Particle Dispersion (HYB6)

A hybrid resin particle dispersion (HYB6) is prepared in the same manner as the hybrid resin particle dispersion (HYB1) except that the hybrid resin HB(1) is replaced with HB(6).

The hybrid resin particles in the dispersion have a volume-average particle size of 119 nm. The solids content of the hybrid resin particle dispersion (HYB6) is adjusted to 20% by adding ion-exchanged water to the dispersion.

Preparation of Hybrid Resin Particle Dispersion (HYB7)

A hybrid resin particle dispersion (HYB7) is prepared in the same manner as the hybrid resin particle dispersion (HYB1) except that the hybrid resin HB(1) is replaced with HB(7).

The hybrid resin particles in the dispersion have a volume-average particle size of 121 nm. The solids content of the hybrid resin particle dispersion (HYB7) is adjusted to 20% by adding ion-exchanged water to the dispersion.

Preparation of Hybrid Resin Particle Dispersion (HYB8)

A hybrid resin particle dispersion (HYB8) is prepared in the same manner as the hybrid resin particle dispersion (HYB1) except that the hybrid resin HB(1) is replaced with HB(8).

The hybrid resin particles in the dispersion have a volume-average particle size of 120 nm. The solids content of the hybrid resin particle dispersion (HYB8) is adjusted to 20% by adding ion-exchanged water to the dispersion.

Preparation of Hybrid Resin Particle Dispersion (HYB9)

A hybrid resin particle dispersion (HYB9) is prepared in the same manner as the hybrid resin particle dispersion (HYB1) except that the rotor rotation speed is changed to 40 Hz.

The hybrid resin particles in the dispersion have a volume-average particle size of 190 nm. The solids content of the hybrid resin particle dispersion (HYB9) is adjusted to 20% by adding ion-exchanged water to the dispersion.

Preparation of Hybrid Resin Particle Dispersion (HYB10)

A hybrid resin particle dispersion (HYB10) is prepared in the same manner as the hybrid resin particle dispersion (HYB1) except that the rotor rotation speed is changed to 70 Hz.

The hybrid resin particles in the dispersion have a volume-average particle size of 95 nm. The solids content of the hybrid resin particle dispersion (HYB10) is adjusted to 20% by adding ion-exchanged water to the dispersion.

Preparation of Hybrid Resin Particle Dispersion (HYB11)

A hybrid resin particle dispersion (HYB11) is prepared in the same manner as the hybrid resin particle dispersion (HYB1) except that the rotor rotation speed is changed to 70 Hz and the pressure is changed to 6 $Kg/cm^2$.

The hybrid resin particles in the dispersion have a volume-average particle size of 86 nm. The solids content of the hybrid resin particle dispersion (HYB11) is adjusted to 20% by adding ion-exchanged water to the dispersion.

Preparation of Vinyl Resin Particle Dispersion (Polystyrene-Acrylic Resin Particle Dispersion PSA1)

Styrene: 77 parts
n-Butyl acrylate: 23 parts
1,10-Decanediol diacrylate: 0.4 parts
Dodecanethiol: 0.7 parts The above materials are mixed and dissolved. To the resulting mixture, a solution of 1.0 part of an anionic surfactant (Dowfax available from The Dow Chemical Company) in 60 parts of ion-exchanged water is added. The mixture is dispersed and emulsified in a flask to prepare an emulsion. Subsequently, 2.0 parts of an anionic surfactant (Dowfax available from The Dow Chemical Company) is dissolved in 90 parts of ion-exchanged water, and 2.0 parts of the emulsion of the above raw materials are added to the solution. Furthermore, a solution of 1.0 part of ammonium persulfate in 10 parts of ion-exchanged water is added thereto. The rest of the emulsion of the above raw materials is then added over 3 hours, and the flask is purged with nitrogen, after which the solution in the flask is heated to 65° C. in an oil bath with stirring. In this state, emulsion polymerization is continued for 5 hours to obtain a polystyrene-acrylic resin particle dispersion (PSA1).

The solids content of the polystyrene-acrylic resin particle dispersion (PSA1) is adjusted to 32% by addition of ion-exchanged water. The polystyrene-acrylic resin particles in the polystyrene-acrylic resin particle dispersion (PSA1) have a volume-average particle size of 102 nm and a weight-average molecular weight (Mw) of 57,000.

Preparation of Vinyl Resin Particle Dispersion (Amorphous Polyester Resin Particle Dispersion PES1)

Ethylene oxide (2.2 mol) adduct of bisphenol A: 40 molar parts
Propylene oxide (2.2 mol) adduct of bisphenol A: 60 molar parts
Dimethyl terephthalate: 60 molar parts
Dimethyl fumarate: 15 molar parts
Dodecenylsuccinic anhydride: 20 molar parts
Trimellitic anhydride: 5 molar parts In a reaction vessel equipped with a stirrer, a thermometer, a condenser, and a nitrogen gas inlet tube, tin dioctanoate and the above monomers except dimethyl fumarate and trimellitic anhydride are placed in an amount of 0.25 parts relative to 100 parts of all the above monomers. The mixture is allowed to react under a stream of nitrogen gas at 235° C. for 6 hours, after which the reaction product is cooled to 200° C., and dimethyl fumarate and trimellitic anhydride are added and allowed to react for 1 hour. The reaction product is heated to 220° C. over 5 hours and polymerized to the desired molecular weight under a pressure of 10 kPa to obtain a light yellow transparent amorphous polyester resin. The amorphous polyester resin has a weight-average molecular weight of 35,000, a number-average molecular weight of 8,000, and a glass transition temperature of 59° C.

The amorphous polyester obtained is then dispersed using a CAVITRON CD1010 disperser (manufactured by Eurotec Ltd.) adapted for high-temperature, high-pressure use to obtain an amorphous polyester resin dispersion (PES1). Specifically, the composition ratio of ion-exchanged water to the polyester resin is 80:20; the pH is adjusted to 8.5 with ammonia; and the CAVITRON is operated under the following conditions: rotor rotation speed, 60 Hz; pressure, 5 $Kg/cm^2$; heating to 140° C. with heat exchanger.

The resin particles in the dispersion have a volume-average particle size of 130 nm. The solids content of the amorphous polyester resin particle dispersion (PES1) is adjusted to 20% by adding ion-exchanged water to the dispersion.

Preparation of Release Agent Dispersion (WAX1)

Hydrocarbon wax: 270 parts (FNP90, Cwax=50, melting temperature=90° C., available from Nippon Seiro Co., Ltd.)

Anionic surfactant: 13.5 parts (Neogen RK, effective amount=60%, 3% relative to release agent, available from Dai-ichi Kogyo Seiyaku Co., Ltd.)

Ion-exchanged water: 21.6 parts

The above materials are mixed together, and the release agent is dissolved with a pressure discharge homogenizer (Gaulin homogenizer manufactured by Gaulin) at an inner-liquid temperature of 120° C. The resulting solution is then subjected to dispersion treatment at a pressure of 5 MPa for 120 minutes and then at 40 MPa for 360 minutes and cooled to obtain a release agent dispersion. The solids content is adjusted to 20% by addition of ion-exchanged water to provide a release agent particle dispersion. The particles in the release agent particle dispersion have a volume-average particle size of 220 nm.

Preparation of Release Agent Dispersion (WAX2)

A release agent particle dispersion (WAX2) is prepared in the same manner as the release agent particle dispersion (WAX1) except that the hydrocarbon wax is replaced with another hydrocarbon wax (PW725, Cwax=70, melting temperature=103° C., available from Toyo Petrolite Co., Ltd).

Release Agent Dispersion (WAX3)

A release agent particle dispersion (WAX3) is prepared in the same manner as the release agent particle dispersion (WAX1) except that the hydrocarbon wax is replaced with another hydrocarbon wax (HNP9, Cwax=36, melting temperature=75° C., available from Nippon Seiro Co., Ltd).

Preparation of Release Agent Dispersion (WAX4)

A release agent particle dispersion (WAX4) is prepared in the same manner as the release agent particle dispersion (WAX1) except that the hydrocarbon wax is replaced with another hydrocarbon wax (FT105, Cwax=75, melting temperature=114° C., available from Nippon Seiro Co., Ltd).

Preparation of Release Agent Dispersion (WAX5)

A release agent particle dispersion (WAX5) is prepared in the same manner as the release agent particle dispersion (WAX1) except that the hydrocarbon wax is replaced with another hydrocarbon wax (FNP80, Cwax=30, melting temperature=72° C., available from Nippon Seiro Co., Ltd).

Preparation of Release Agent Dispersion (WAX6)

A release agent particle dispersion (WAX6) is prepared in the same manner as the release agent particle dispersion (WAX1) except that the amount of anionic surfactant is changed to 11.0 parts and that the dispersion treatment is performed at a pressure of 5 MPa for 120 minutes and then at 40 MPa for 180 minutes. The particles in the release agent particle dispersion have a volume-average particle size of 290 nm.

Preparation of Release Agent Dispersion (WAX7)

A release agent particle dispersion (WAX7) is prepared in the same manner as the release agent particle dispersion (WAX1) except that the amount of anionic surfactant is changed to 16.0 parts and that the dispersion treatment is performed at a pressure of 5 MPa for 120 minutes and then at 40 MPa for 720 minutes. The particles in the release agent particle dispersion have a volume-average particle size of 148 nm.

Preparation of Release Agent Dispersion (WAX8)

A release agent particle dispersion (WAX8) is prepared in the same manner as the release agent particle dispersion (WAX1) except that the hydrocarbon wax is replaced with an ester wax (CLOVAX 100-7s, Cwax=43, melting temperature=72° C., available from Nippon Seiro Co., Ltd).

Colorant Dispersion: Preparation of Black Pigment Dispersion

Carbon black (Regal 330 available from Cabot Corporation): 250 parts

Anionic surfactant (Neogen SC available from Dai-ichi Kogyo Seiyaku Co., Ltd.): 33 parts (effective amount=60%, 8% relative to colorant)

Ion-exchanged water: 750 parts

In a stainless steel vessel sized to be filled to about one-third of its height when all the above materials are placed therein, 280 parts of ion-exchanged water and 33 parts of the anionic surfactant are placed. After the surfactant is sufficiently dissolved, all carbon black is added, and the mixture is stirred using a stirrer until there is no dry pigment and is sufficiently degassed. After degassing, the remaining ion-exchanged water is added, and the mixture is dispersed using a homogenizer (Ultra-Turrax T50 manufactured by IKA) at 5,000 rpm for 10 minutes and then degassed with stirring using a stirrer for one day. After degassing, the mixture is dispersed again at 6,000 rpm using the homogenizer for 10 minutes and then degassed with stirring using a stirrer for one day. The mixture is further dispersed at a pressure of 240 MPa using a high-pressure impact disperser (Ultimaizer HJP-30006 manufactured by Sugino Machine Limited). The dispersion is performed in 25 equivalent passes on the basis of the total amount of feed and the processing capacity of the machine. The resulting dispersion is left to stand for 72 hours, and the sediment is removed. Ion-exchanged water is added to a solids content of 15% to obtain a black pigment dispersion. The particles in the black pigment dispersion have a volume-average particle size of 135 nm.

Preparation of Mixed Dispersion 1

Vinyl resin particle dispersion (PSA1): 28.6 parts

Ion-exchanged water: 40.0 parts

Anionic surfactant (Dowfax 2A1 available from The Dow Chemical Company): 0.4 parts The above materials are mixed together to obtain a mixed dispersion (1).

Preparation of Mixed Dispersion 2

Vinyl resin particle dispersion (PSA1): 14.2 parts
Release agent dispersion 1: 20.7 parts
Ion-exchanged water: 20.0 parts
Anionic surfactant (Dowfax 2A1 available from The Dow Chemical Company): 0.2 parts The above materials are mixed together to obtain a mixed dispersion (2).

Preparation of Mixed Dispersions 3 to 22

The dispersions (the type and amount thereof are shown in Table 2) are mixed together to obtain mixed dispersions (3) to (22).

TABLE 2

| | Hybrid resin particle dispersion | | Release agent particle dispersion | | Vinyl resin particle dispersion | | Ion-exchanged water | Anionic surfactant | Total amount |
|---|---|---|---|---|---|---|---|---|---|
| | Type | [Parts] | Type | [Parts] | Type | [Parts] | [parts] | [parts] | [parts] |
| Mixed dispersion 1 | — | — | — | — | PSA1 | 28.6 | 40 | 0.4 | 69 |
| Mixed dispersion 2 | — | — | WAX1 | 20.7 | PSA1 | 14.2 | 20 | 0.2 | 55 |
| Mixed dispersion 3 | — | — | — | — | PSA1 | 35.5 | 46.8 | 0.5 | 83 |
| Mixed dispersion 4 | — | — | WAX1 | 20.7 | PSA1 | 7.1 | 13.2 | 0.13 | 41 |
| Mixed dispersion 5 | — | — | — | — | PSA1 | 36.1 | 46.8 | 0.52 | 83 |
| Mixed dispersion 6 | — | — | WAX1 | 20.7 | PSA1 | 6.5 | 12.4 | 0.08 | 40 |
| Mixed dispersion 7 | — | — | WAX2 | 20.7 | PSA1 | 14.2 | 20 | 0.2 | 55 |
| Mixed dispersion 8 | — | — | WAX3 | 20.7 | PSA1 | 14.2 | 20 | 0.2 | 55 |
| Mixed dispersion 9 | — | — | WAX4 | 20.7 | PSA1 | 14.2 | 20 | 0.2 | 55 |
| Mixed dispersion 10 | — | — | WAX5 | 20.7 | PSA1 | 14.2 | 20 | 0.2 | 55 |
| Mixed dispersion 11 | — | — | WAX6 | 20.7 | PSA1 | 14.2 | 20 | 0.2 | 55 |
| Mixed dispersion 12 | — | — | WAX7 | 20.7 | PSA1 | 14.2 | 20 | 0.2 | 55 |
| Mixed dispersion 13 | — | — | WAX1 | 6.4 | PSA1 | 28.6 | 40 | 0.4 | 75 |
| Mixed dispersion 14 | — | — | WAX1 | 8.9 | PSA1 | 14.2 | 20 | 0.2 | 43 |
| Mixed dispersion 15 | — | — | WAX1 | 8.9 | PSA1 | 14.2 | 100 | 0.2 | 123 |
| Mixed dispersion 16 | — | — | WAX1 | 7.1 | PSA1 | 28.6 | 40 | 0.4 | 76 |
| Mixed dispersion 17 | — | — | WAX1 | 8 | PSA1 | 14.2 | 20 | 0.2 | 42 |
| Mixed dispersion 18 | — | — | WAX8 | 20.7 | PSA1 | 14.2 | 20 | 0.2 | 55 |
| Mixed dispersion 19 | HYB1 | 29.6 | — | — | PSA1 | 14.2 | 20 | 0.2 | 64 |
| Mixed dispersion 20 | HYB1 | 29.6 | — | — | PSA1 | 28.6 | 40 | 0.4 | 99 |
| Mixed dispersion 21 | — | — | — | — | PES1 | 28.6 | 40 | 0.4 | 69 |
| Mixed dispersion 22 | — | — | WAX1 | 20.7 | PES1 | 14.2 | 20 | 0.2 | 55 |

Production of Toner Particles

Example 1

First Aggregated Particle Forming Step

Hybrid resin particle dispersion (HYB1): 29.6 parts
Vinyl resin particle dispersion (PSA1): 100 parts
Black pigment dispersion: 23.7 parts
Ion-exchanged water: 200 parts
Anionic surfactant (Dowfax 2A1 available from The Dow Chemical Company): 2.0 parts The above materials are placed in a 3 L reaction vessel equipped with a thermometer, a pH meter, and a stirrer, and 1.0% nitric acid is added thereto at 25° C. to adjust the pH to 3.0. The mixture is then dispersed with a homogenizer (Ultra-Turrax T50 manufactured by IKA) at 5,000 rpm for 6 minutes while adding 100 parts of 2.0% aqueous magnesium chloride solution serving as a coagulant.

The reaction vessel is then equipped with a mantle heater. The temperature is raised to 40° C. at a rate of 0.2° C./min and then to 53° C. at a rate of 0.05° C./min while the number of rotations of the stirrer is controlled so that the slurry is sufficiently stirred. During this process, the particle size is measured using a Multisizer II (aperture size=50 μm, manufactured by Beckman Coulter, Inc.) every 10 minutes. When a volume-average particle size of 4.2 μm is reached, the temperature is maintained to prepare a first aggregated particle dispersion.

Second Aggregated Particle Forming Step

To the first aggregated particle dispersion, 69.0 parts of the mixed dispersion (1) is added over 5 minutes, and the mixture is maintained for 20 minutes. Thereafter, 55.1 parts of the mixed dispersion (2) is added over 5 minutes, and the mixture is maintained for 20 minutes to prepare a second aggregated particle dispersion.

Fusion and Coalescence Step

The second aggregated particle dispersion is maintained at 50° C. for 30 minutes, and 8 parts of 20% ethylenediaminetetraacetic acid (EDTA) solution is added to the reaction vessel. Thereafter, 1 mol/L aqueous sodium hydroxide solution is added to adjust the pH of the raw material dispersion to 9.0. While adjusting the pH to 9.0 every 5° C., the temperature is then raised to 90° C. at a rate of 1° C./min and maintained at 90° C. The shape and surface conditions of the particles are observed under a light microscope and a field-emission scanning electron microscope (FE-SEM). The coalescence of the particles is observed after 6 hours, and the vessel is cooled to 30° C. with cooling water over 5 minutes.

The cooled slurry is passed through a nylon mesh with 15 μm openings to remove coarse particles, and the toner slurry passed through the mesh is filtered under reduced pressure using an aspirator. The solid remaining on the filter paper is crushed by hand as finely as possible, and at 30° C., the crushed particles are added to ion-exchanged water in an amount of 10 times the amount of the solid and mixed with stirring for 30 minutes. The mixture is then filtered under reduced pressure using an aspirator. The solid remaining on the filter paper is crushed by hand as finely as possible, and at 30° C., the crushed particles are added to ion-exchanged water in an amount of 10 times the amount of the solid and mixed with stirring for 30 minutes, after which the mixture is filtered again under reduced pressure using an aspirator, and the electrical conductivity of the filtrate is measured. This procedure is repeated until the electrical conductivity of the filtrate reaches 10 μS/cm or less, and the solid is washed.

The washed solid is finely crushed in a wet/dry mill (Comil) and is vacuum-dried in an oven at 35° C. for 36 hours to obtain toner particles. The toner particles have a volume-average particle size of 5.7 μm.

Addition of External Additive

Next, 1.5 parts of hydrophobic silica (RY50, available from Nippon Aerosil Co., Ltd.), which is an external additive, is added to 100 parts of the toner particles obtained and mixed using a sample mill at 13,000 rpm for 30 seconds. The mixture is then sifted with an oscillating sieve with 45 μm openings to obtain an electrostatic image developing toner of Example 1.

Measurements

The average area fraction, average number, and average size of release agent domains and hybrid resin domains of the toner obtained in Example 1 are measured according to the methods described above. The measurement results are shown in Table 4.

Conditions for producing toners of Examples 1 to 41 and Comparative Examples 1 to 6 are shown in Table 3.

Example 2

A toner having the properties shown in Table 4 is obtained in the same manner as in Example 1 except that in the second aggregated particle forming step in producing the toner, the mixed dispersion (1) is replaced with 82.3 parts of the mixed dispersion (3) and the mixed dispersion (2) is replaced with 41.1 parts of the mixed dispersion (4).

Example 3

A toner having the properties shown in Table 4 is obtained in the same manner as in Example 1 except that in the second aggregated particle forming step in producing the toner, the mixed dispersion (1) is replaced with 55.1 parts of the mixed dispersion (2) and the mixed dispersion (2) is replaced with 69.0 parts of the mixed dispersion (1).

Example 4

A toner having the properties shown in Table 4 is obtained in the same manner as in Example 1 except that in the second aggregated particle forming step in producing the toner, the mixed dispersion (1) is replaced with 83.4 parts of the mixed dispersion (5) and the mixed dispersion (2) is replaced with 39.7 parts of the mixed dispersion (6).

Example 5

A toner having the properties shown in Table 4 is obtained in the same manner as in Example 1 except that in the second aggregated particle forming step in producing the toner, the mixed dispersion (1) is replaced with 39.7 parts of the mixed dispersion (6) and the mixed dispersion (2) is replaced with 83.4 parts of the mixed dispersion (5).

Example 6

A toner having the properties shown in Table 4 is obtained in the same manner as in Example 1 except that in the first aggregated particle forming step in producing the toner, the hybrid resin dispersion (HYB1) is replaced with (HYB2).

Example 7

A toner having the properties shown in Table 4 is obtained in the same manner as in Example 1 except that in the first aggregated particle forming step in producing the toner, the hybrid resin dispersion (HYB1) is replaced with (HYB3).

Example 8

A toner having the properties shown in Table 4 is obtained in the same manner as in Example 1 except that in the first aggregated particle forming step in producing the toner, the hybrid resin dispersion (HYB1) is replaced with (HYB4).

Example 9

A toner having the properties shown in Table 4 is obtained in the same manner as in Example 1 except that in the first aggregated particle forming step in producing the toner, the hybrid resin dispersion (HYB1) is replaced with (HYB5).

Example 10

A toner having the properties shown in Table 4 is obtained in the same manner as in Example 1 except that in the second aggregated particle forming step in producing the toner, the mixed dispersion (2) is replaced with the mixed dispersion (7).

Example 11

A toner having the properties shown in Table 4 is obtained in the same manner as in Example 1 except that in the second aggregated particle forming step in producing the toner, the mixed dispersion (2) is replaced with (8).

Example 12

A toner having the properties shown in Table 4 is obtained in the same manner as in Example 1 except that in the second aggregated particle forming step in producing the toner, the mixed dispersion (2) is replaced with (9).

Example 13

A toner having the properties shown in Table 4 is obtained in the same manner as in Example 1 except that in the second aggregated particle forming step in producing the toner, the mixed dispersion (2) is replaced with (10).

Example 14

A toner having the properties shown in Table 4 is obtained in the same manner as in Example 1 except that in the first aggregated particle forming step in producing the toner, the hybrid resin dispersion (HYB1) is replaced with (HYB3), and in the second aggregated particle forming step, the mixed dispersion (2) is replaced with (8).

Example 15

A toner having the properties shown in Table 4 is obtained in the same manner as in Example 1 except that in the first aggregated particle forming step in producing the toner, the hybrid resin dispersion (HYB1) is replaced with (HYB2), and in the second aggregated particle forming step, the mixed dispersion (2) is replaced with (7).

Example 16

A toner having the properties shown in Table 4 is obtained in the same manner as in Example 1 except that in the first aggregated particle forming step in producing the toner, the hybrid resin dispersion (HYB1) is replaced with (HYB3), and in the second aggregated particle forming step, the mixed dispersion (2) is replaced with (7).

Example 17

A toner having the properties shown in Table 4 is obtained in the same manner as in Example 1 except that in the first aggregated particle forming step in producing the toner, the hybrid resin dispersion (HYB1) is replaced with (HYB2), and in the second aggregated particle forming step, the mixed dispersion (2) is replaced with (8).

Example 18

A toner having the properties shown in Table 4 is obtained in the same manner as in Example 1 except that in the first aggregated particle forming step in producing the toner, the hybrid resin dispersion (HYB1) is replaced with (HYB6).

Example 19

A toner having the properties shown in Table 4 is obtained in the same manner as in Example 1 except that in the first aggregated particle forming step in producing the toner, the hybrid resin dispersion (HYB1) is replaced with (HYB7).

Example 20

A toner having the properties shown in Table 4 is obtained in the same manner as in Example 1 except that in the first aggregated particle forming step in producing the toner, the hybrid resin dispersion (HYB1) is replaced with (HYB8).

Example 21

A toner having the properties shown in Table 4 is obtained in the same manner as in Example 1 except that in the second aggregated particle forming step in producing the toner, the mixed dispersion (2) is replaced with (11), and in the fusion and coalescence step, the pH is adjusted to 9.0, and then the temperature is raised to 94° C. at a rate of 1° C./min and maintained at 94° C.

Example 22

A toner having the properties shown in Table 4 is obtained in the same manner as in Example 1 except that in the second aggregated particle forming step in producing the toner, the mixed dispersion (2) is replaced with (12).

Example 23

A toner having the properties shown in Table 4 is obtained in the same manner as in Example 1 except that in the second aggregated particle forming step in producing the toner, the mixed dispersion (2) is replaced with (11), and in the fusion and coalescence step, the pH is adjusted to 9.0, then the temperature is raised to 94° C. at a rate of 1° C./min and maintained at 94° C., and the vessel is cooled to 30° C. over 60 minutes.

Example 24

A toner having the properties shown in Table 4 is obtained in the same manner as in Example 1 except that in the second aggregated particle forming step in producing the toner, the mixed dispersion (2) is replaced with (12), and in the fusion and coalescence step, the pH is adjusted to 9.0, and then the temperature is raised to 85° C. at a rate of 1° C./min and maintained at 85° C.

Example 25

A toner having the properties shown in Table 4 is obtained in the same manner as in Example 1 except that in the first aggregated particle forming step in producing the toner, the hybrid resin dispersion (HYB1) is replaced with (HYB9).

Example 26

A toner having the properties shown in Table 4 is obtained in the same manner as in Example 1 except that in the first aggregated particle forming step in producing the toner, the hybrid resin dispersion (HYB1) is replaced with (HYB10).

Example 27

A toner having the properties shown in Table 4 is obtained in the same manner as in Example 1 except that in the first aggregated particle forming step in producing the toner, the hybrid resin dispersion (HYB1) is replaced with (HYB9), and the heating conditions are changed such that the temperature is raised to 40° C. at a rate of 1.0° C./min and then to 53° C. at a rate of 0.2° C./min.

Example 28

A toner having the properties shown in Table 4 is obtained in the same manner as in Example 1 except that in the first aggregated particle forming step in producing the toner, the hybrid resin dispersion (HYB1) is replaced with (HYB11), and the heating conditions are changed such that the temperature is raised to 40° C. at a rate of 0.05° C./min and then to 53° C. at a rate of 0.02° C./rain.

Example 29

A toner having the properties shown in Table 4 is obtained in the same manner as in Example 1 except that in the first aggregated particle forming step in producing the toner, the amount of hybrid resin dispersion is changed to 44.4 parts, and in the fusion and coalescence step, the pH is adjusted to 9.0, and then the temperature is raised to 94° C. at a rate of 1° C./min and maintained at 94° C.

Example 30

A toner having the properties shown in Table 4 is obtained in the same manner as in Example 1 except that in the first aggregated particle forming step in producing the toner, the amount of hybrid resin dispersion is changed to 14.8 parts, and in the second aggregated particle forming step, the mixed dispersion (1) is replaced with the mixed dispersion (14).

Example 31

A toner having the properties shown in Table 4 is obtained in the same manner as in Example 1 except that in the first aggregated particle forming step in producing the toner, the amount of hybrid resin dispersion is changed to 53.3 parts and the amount of ion-exchanged water is changed to 400 parts.

Example 32

A toner having the properties shown in Table 4 is obtained in the same manner as in Example 1 except that in the first aggregated particle forming step in producing the toner, the amount of hybrid resin dispersion is changed to 14.8 parts; in the second aggregated particle forming step, the mixed dispersion (1) is replaced with the mixed dispersion (15); and in the fusion and coalescence step, the pH is adjusted to 9.0, and then the temperature is raised to 85° C. at a rate of 1° C./min and maintained at 85° C.

Example 33

A toner having the properties shown in Table 4 is obtained in the same manner as in Example 1 except that in the second aggregated particle forming step in producing the toner, the mixed dispersion (1) is replaced with the mixed dispersion (13).

Example 34

A toner having the properties shown in Table 4 is obtained in the same manner as in Example 1 except that in the second aggregated particle forming step in producing the toner, the mixed dispersion (2) is replaced with the mixed dispersion (14).

Example 35

A toner having the properties shown in Table 4 is obtained in the same manner as in Example 1 except that in the second aggregated particle forming step in producing the toner, the mixed dispersion (1) is replaced with the mixed dispersion (16).

Example 36

A toner having the properties shown in Table 4 is obtained in the same manner as in Example 1 except that in the second aggregated particle forming step in producing the toner, the mixed dispersion (2) is replaced with the mixed dispersion (17).

Example 37

A toner having the properties shown in Table 4 is obtained in the same manner as in Example 1 except that in the first aggregated particle forming step in producing the toner, the amount of hybrid resin dispersion is changed to 44.4 parts.

Example 38

A toner having the properties shown in Table 4 is obtained in the same manner as in Example 1 except that in the first aggregated particle forming step in producing the toner, the amount of hybrid resin dispersion is changed to 14.8 parts.

Example 39

A toner having the properties shown in Table 4 is obtained in the same manner as in Example 1 except that in the first aggregated particle forming step in producing the toner, the amount of hybrid resin dispersion is changed to 64.0 parts.

Example 40

A toner having the properties shown in Table 4 is obtained in the same manner as in Example 1 except that in the first aggregated particle forming step in producing the toner, the amount of hybrid resin dispersion is changed to 10.0 parts.

Example 41

A toner having the properties shown in Table 4 is obtained in the same manner as in Example 1 except that in the first aggregated particle forming step in producing the toner, no hybrid resin dispersions are used, and in the second aggregated particle forming step, the mixed dispersion (1) is replaced with the mixed dispersion (20).

Comparative Example 1

A toner is obtained in the same manner as in Example 1 except that the second aggregated particle forming step is omitted, and the first aggregated particle forming step and the second aggregated particle forming step are integrated into a single aggregated particle forming step involving the following procedure.

Release agent particle dispersion (WAX1): 20.7 parts
Hybrid resin particle dispersion (HYB1): 29.6 parts
Vinyl resin particle dispersion (PSA1): 100 parts
Black pigment dispersion: 23.7 parts
Ion-exchanged water: 200 parts
Anionic surfactant (Dowfax 2A1 available from The Dow Chemical Company): 2.0 parts The above materials are placed in a 3 L reaction vessel equipped with a thermometer, a pH meter, and a stirrer, and 1.0% nitric acid is added thereto at 25° C. to adjust the pH to 3.0. The mixture is then dispersed with a homogenizer (Ultra-Turrax T50 manufactured by IKA) at 5,000 rpm for 6 minutes while adding 100 parts of 2.0% aqueous magnesium chloride solution serving as a coagulant.

The reaction vessel is then equipped with a mantle heater. The temperature is raised to 40° C. at a rate of 0.2° C./min and then to 53° C. at a rate of 0.05° C./min while the number of rotations of the stirrer is controlled so that the slurry is sufficiently stirred. During this process, the particle size is measured using a Multisizer II (aperture size=50 μm, manufactured by Beckman Coulter, Inc.) every 10 minutes. When a volume-average particle size of 5.9 μm is reached, the temperature is maintained to prepare an aggregated particle dispersion.

Comparative Example 2

A toner having the properties shown in Table 4 is obtained in the same manner as in Example 1 except that in the aggregated particle forming step in producing the toner, no hybrid resin particle dispersions are used.

Comparative Example 3

A toner having the properties shown in Table 4 is obtained in the same manner as in Example 1 except that in the aggregated particle forming step in producing the toner, a crystalline polyester resin particle dispersion is used instead of a hybrid resin particle dispersion. The crystalline polyester resin particle dispersion is prepared according to the following procedure.

Synthesis of Crystalline Polyester Resin and Preparation of Particle Dispersion Thereof In a three-necked flask dried by heating, 266 parts of 1,10-decanedicarboxylic acid, 169 parts of 1,6-hexanediol, and 0.035 parts of tetrabutoxy titanate serving as a catalyst are placed. The flask is then evacuated by reducing the pressure and further purged with nitrogen gas to provide an inert atmosphere, and the mixture is refluxed with mechanical stirring at 180° C. for 6 hours. The mixture is then gradually heated to 220° C. under vacuum distillation and stirred for 2.5 hours. When the mixture becomes viscous, the acid value thereof is measured. When the acid value reaches 15.0 mgKOH/g, vacuum distillation is stopped, and the reaction product is cooled in air to obtain a crystalline polyester resin.

The weight-average molecular weight (Mw) of the crystalline polyester resin is measured by the above-described method to be 13,000. The melting temperature of the crystalline polyester resin is measured using a differential scanning calorimeter (DSC) to be 73° C.

Next, 180 parts of the crystalline polyester resin and 585 parts of deionized water are placed in a stainless steel beaker, and the beaker is heated to 95° C. in a hot bath. When the crystalline polyester resin melts, the mixture is stirred at 8,000 rpm with a homogenizer (Ultra-Turrax T50 manufactured by IKA) while adding dilute aqueous ammonia to a pH of 7.0. The mixture is then dispersed and emulsified while adding dropwise 20 parts of an aqueous solution containing 0.8 parts of an anionic surfactant (Neogen R available from Dai-Ichi Kogyo Seiyaku Co., Ltd.) to prepare a crystalline polyester resin particle dispersion (resin particle concentration: 40% by mass) having a volume-average particle size of 0.18 μm.

Comparative Example 4

A toner having the properties shown in Table 4 is obtained in the same manner as in Example 1 except that in the aggregated particle forming step in producing the toner, the vinyl resin particle dispersion (polystyrene-acrylic resin particle dispersion PSA1) is replaced with an amorphous polyester resin particle dispersion (PES1), the mixed dispersion (1) is replaced with (21), and the mixed dispersion (2) is replaced with (22).

Comparative Example 5

A toner having the properties shown in Table 4 is obtained in the same manner as in Example 1 except that in the aggregated particle forming step in producing the toner, the release agent particle dispersion (WAX1) including a hydrocarbon wax is replaced with the release agent particle dispersion (WAX8) including an ester wax (i.e., except that in the second aggregated particle forming step, the mixed dispersion (2) is replaced with (18)).

Comparative Example 6

A toner having the properties shown in Table 4 is obtained in the same manner as in Example 1 except that in the first aggregated particle forming step in producing the toner, 20.7 parts of the release agent dispersion (WAX1) is used instead of a hybrid resin dispersion, and in the second aggregated particle forming step, the mixed dispersion (2) is replaced with the mixed dispersion (19).

Evaluation of Filming

After the toner of each example is stored in a high-temperature and high-humidity environment (45° C., 90%) for 30 days, an electrostatic latent image developer is produced, and the occurrence of filming is evaluated by performing the following test.

The developer produced is loaded into an evaluation machine "D110 (manufactured by Fuji Xerox Co., Ltd)". Under the conditions at 35° C. and 80% Rh, an image having an area coverage of 1% and a width of 5 cm is output on Vitality paper at 15 kpv (pv=the number of sheets on which the image is formed (print volume)), and then a full-page halftone 50% image is output on ten sheets. The occurrence of filming on the photoreceptor is checked with a microscope, and the halftone image is checked whether there is a white streak or color streak thereon. The evaluation is made according to the following evaluation criteria. The evaluation results are shown in Table 4.

A: No filming on the photoreceptor, no white streaks or color streaks on the image B: Little filming on the photoreceptor, no white streaks or color streaks on the image C: Streak-like filming on the photoreceptor, no white streaks or color streaks on the image D: Streak-like filming on the photoreceptor, white streaks or color streaks on the image Evaluation of Low-Temperature Fixability The electrostatic image developer obtained in each example is loaded into a developing device of a DocuCentreIV C3370 color copier (manufactured by Fuji Xerox Co., Ltd.) from which a fixing device is detached, and an unfixed image is output. Specifically, a sheet of Vitality paper is used as a recording medium, and an unfixed image having an area coverage of 50% and measuring 25 mm×25 mm is formed on one side of the sheet. For fixation evaluation, a fixing device detached from a DocuPrintP450 manufactured by Fuji Xerox Co., Ltd. and adapted to enable changing of the fixing temperature is used.

The fixing device has a nip width of 7 mm, a nip pressure of 2.0 kgf/cm$^2$, a dwell time of 26.9 ms, and a processing speed of 260 mm/s. The fixing temperature is raised from 80° C. to 220° C. in increments of 5° C. to fix the unfixed image.

The fixed image is put on a friction tester (FR2 manufactured by Suga Test Instruments Co., Ltd.), and the residual percentage is calculated from image densities before and after 10 reciprocations. The temperature at which the residual percentage is 95% or more is used as a measure for evaluating the low-temperature fixability of the HT image.

The evaluation is made according to the following evaluation criteria. The evaluation results are shown in Table 4.

A: Lower than 140° C.

B: 140° C. or higher and lower than 150° C.

C: 150° C. or higher and lower than 160° C.

D: 160° C. or higher

TABLE 3

| | First aggregated particle forming step (materials) | | | | | | | | |
|---|---|---|---|---|---|---|---|---|---|
| | Hybrid resin particle dispersion | | Release agent particle dispersion | | Vinyl resin particle dispersion | | Pigment particle | Ion-exchanged | |
| | Type | [Parts] | Type | [Parts] | Type | [Parts] | dispersion | water | Surfactant |
| Example 1 | HYB1 | 29.6 | — | 0 | PSA1 | 100 | 23.7 | 200 | 2 |
| Example 2 | HYB1 | 29.6 | — | 0 | PSA1 | 100 | 23.7 | 200 | 2 |
| Example 3 | HYB1 | 29.6 | — | 0 | PSA1 | 100 | 23.7 | 200 | 2 |
| Example 4 | HYB1 | 29.6 | — | 0 | PSA1 | 100 | 23.7 | 200 | 2 |
| Example 5 | HYB1 | 29.6 | — | 0 | PSA1 | 100 | 23.7 | 200 | 2 |
| Example 6 | HYB2 | 29.6 | — | 0 | PSA1 | 100 | 23.7 | 200 | 2 |
| Example 7 | HYB3 | 29.6 | — | 0 | PSA1 | 100 | 23.7 | 200 | 2 |
| Example 8 | HYB4 | 29.6 | — | 0 | PSA1 | 100 | 23.7 | 200 | 2 |
| Example 9 | HYB5 | 29.6 | — | 0 | PSA1 | 100 | 23.7 | 200 | 2 |
| Example 10 | HYB1 | 29.6 | — | 0 | PSA1 | 100 | 23.7 | 200 | 2 |
| Example 11 | HYB1 | 29.6 | — | 0 | PSA1 | 100 | 23.7 | 200 | 2 |
| Example 12 | HYB1 | 29.6 | — | 0 | PSA1 | 100 | 23.7 | 200 | 2 |
| Example 13 | HYB1 | 29.6 | — | 0 | PSA1 | 100 | 23.7 | 200 | 2 |
| Example 14 | HYB3 | 29.6 | — | 0 | PSA1 | 100 | 23.7 | 200 | 2 |
| Example 15 | HYB2 | 29.6 | — | 0 | PSA1 | 100 | 23.7 | 200 | 2 |
| Example 16 | HYB3 | 29.6 | — | 0 | PSA1 | 100 | 23.7 | 200 | 2 |
| Example 17 | HYB2 | 29.6 | — | 0 | PSA1 | 100 | 23.7 | 200 | 2 |
| Example 18 | HYB6 | 29.6 | — | 0 | PSA1 | 100 | 23.7 | 200 | 2 |
| Example 19 | HYB7 | 29.6 | — | 0 | PSA1 | 100 | 23.7 | 200 | 2 |
| Example 20 | HYB8 | 29.6 | — | 0 | PSA1 | 100 | 23.7 | 200 | 2 |
| Example 21 | HYB1 | 29.6 | — | 0 | PSA1 | 100 | 23.7 | 200 | 2 |
| Example 22 | HYB1 | 29.6 | — | 0 | PSA1 | 100 | 23.7 | 200 | 2 |
| Example 23 | HYB1 | 29.6 | — | 0 | PSA1 | 100 | 23.7 | 200 | 2 |
| Example 24 | HYB1 | 29.6 | — | 0 | PSA1 | 100 | 23.7 | 200 | 2 |
| Example 25 | HYB9 | 29.6 | — | 0 | PSA1 | 100 | 23.7 | 200 | 2 |
| Example 26 | HYB10 | 29.6 | — | 0 | PSA1 | 100 | 23.7 | 200 | 2 |
| Example 27 | HYB9 | 29.6 | — | 0 | PSA1 | 100 | 23.7 | 200 | 2 |
| Example 28 | HYB11 | 29.6 | — | 0 | PSA1 | 100 | 23.7 | 200 | 2 |
| Example 29 | HYB1 | 44.4 | — | 0 | PSA1 | 100 | 23.7 | 200 | 2 |
| Example 30 | HYB1 | 14.8 | — | 0 | PSA1 | 100 | 23.7 | 200 | 2 |
| Example 31 | HYB1 | 53.3 | — | 0 | PSA1 | 100 | 23.7 | 400 | 2 |
| Example 32 | HYB1 | 14.8 | — | 0 | PSA1 | 100 | 23.7 | 200 | 2 |
| Example 33 | HYB1 | 29.6 | — | 0 | PSA1 | 100 | 23.7 | 200 | 2 |
| Example 34 | HYB1 | 29.6 | — | 0 | PSA1 | 100 | 23.7 | 200 | 2 |
| Example 35 | HYB1 | 29.6 | — | 0 | PSA1 | 100 | 23.7 | 200 | 2 |
| Example 36 | HYB1 | 29.6 | — | 0 | PSA1 | 100 | 23.7 | 200 | 2 |
| Example 37 | HYB1 | 44.4 | — | 0 | PSA1 | 100 | 23.7 | 200 | 2 |
| Example 38 | HYB1 | 14.8 | — | 0 | PSA1 | 100 | 23.7 | 200 | 2 |
| Example 39 | HYB1 | 64.0 | — | 0 | PSA1 | 100 | 23.7 | 200 | 2 |
| Example 40 | HYB1 | 10.0 | — | 0 | PSA1 | 100 | 23.7 | 200 | 2 |
| Example 41 | — | 0.0 | — | 0 | PSA1 | 100 | 23.7 | 200 | 2 |
| Comparative Example 1 | HYB1 | 29.6 | Wax1 | 20.7 | PSA1 | 100 | 23.7 | 200 | 2 |
| Comparative Example 2 | —*1 | 0 | — | 0 | PSA1 | 100 | 23.7 | 200 | 2 |
| Comparative Example 3 | —*2 | 29.6*2 | — | 0 | PSA1 | 100 | 23.7 | 200 | 2 |
| Comparative Example 4 | HYB1 | 29.6 | — | 0 | PES1*4 | 100 | 23.7 | 200 | 2 |
| Comparative Example 5*3 | HYB1 | 29.6 | — | 0 | PSA1 | 100 | 23.7 | 200 | 2 |
| Comparative Example 6 | — | — | Wax1 | 20.7 | PSA1 | 100 | 23.7 | 200 | 2 |

| | Second aggregated particle forming step | | Composition ratio | |
|---|---|---|---|---|
| | | | Release agent/ toner particles | Hybrid resin/ release agent |
| | 1 | 2 | [w %] | [w %] |
| Example 1 | mixed dispersion 1 | mixed dispersion 2 | 7.0 | 143 |
| Example 2 | mixed dispersion 3 | mixed dispersion 4 | 7.0 | 143 |
| Example 3 | mixed dispersion 2 | mixed dispersion 1 | 7.0 | 143 |
| Example 4 | mixed dispersion 5 | mixed dispersion 6 | 7.0 | 143 |
| Example 5 | mixed dispersion 6 | mixed dispersion 5 | 7.0 | 143 |
| Example 6 | mixed dispersion 1 | mixed dispersion 2 | 7.0 | 143 |
| Example 7 | mixed dispersion 1 | mixed dispersion 2 | 7.0 | 143 |
| Example 8 | mixed dispersion 1 | mixed dispersion 2 | 7.0 | 143 |
| Example 9 | mixed dispersion 1 | mixed dispersion 2 | 7.0 | 143 |
| Example 10 | mixed dispersion 1 | mixed dispersion 7 | 7.0 | 143 |
| Example 11 | mixed dispersion 1 | mixed dispersion 8 | 7.0 | 143 |

TABLE 3-continued

| | | | | |
|---|---|---|---|---|
| Example 12 | mixed dispersion 1 | mixed dispersion 9 | 7.0 | 143 |
| Example 13 | mixed dispersion 1 | mixed dispersion 10 | 7.0 | 143 |
| Example 14 | mixed dispersion 1 | mixed dispersion 8 | 7.0 | 143 |
| Example 15 | mixed dispersion 1 | mixed dispersion 7 | 7.0 | 143 |
| Example 16 | mixed dispersion 1 | mixed dispersion 7 | 7.0 | 143 |
| Example 17 | mixed dispersion 1 | mixed dispersion 8 | 7.0 | 143 |
| Example 18 | mixed dispersion 1 | mixed dispersion 2 | 7.0 | 143 |
| Example 19 | mixed dispersion 1 | mixed dispersion 2 | 7.0 | 143 |
| Example 20 | mixed dispersion 1 | mixed dispersion 2 | 7.0 | 143 |
| Example 21 | mixed dispersion 1 | mixed dispersion 11 | 7.0 | 143 |
| Example 22 | mixed dispersion 1 | mixed dispersion 12 | 7.0 | 143 |
| Example 23 | mixed dispersion 1 | mixed dispersion 11 | 7.0 | 143 |
| Example 24 | mixed dispersion 1 | mixed dispersion 12 | 7.0 | 143 |
| Example 25 | mixed dispersion 1 | mixed dispersion 2 | 7.0 | 143 |
| Example 26 | mixed dispersion 1 | mixed dispersion 2 | 7.0 | 143 |
| Example 27 | mixed dispersion 1 | mixed dispersion 2 | 7.0 | 143 |
| Example 28 | mixed dispersion 1 | mixed dispersion 2 | 7.0 | 143 |
| Example 29 | mixed dispersion 1 | mixed dispersion 2 | 6.6 | 214 |
| Example 30 | mixed dispersion 14 | mixed dispersion 2 | 11.1 | 50 |
| Example 31 | mixed dispersion 1 | mixed dispersion 2 | 6.5 | 258 |
| Example 32 | mixed dispersion 15 | mixed dispersion 2 | 11.1 | 50 |
| Example 33 | mixed dispersion 13 | mixed dispersion 2 | 8.9 | 109 |
| Example 34 | mixed dispersion 1 | mixed dispersion 14 | 3.1 | 333 |
| Example 35 | mixed dispersion 16 | mixed dispersion 2 | 9.2 | 106 |
| Example 36 | mixed dispersion 1 | mixed dispersion 17 | 2.8 | 370 |
| Example 37 | mixed dispersion 1 | mixed dispersion 2 | 6.6 | 214 |
| Example 38 | mixed dispersion 1 | mixed dispersion 2 | 7.3 | 71 |
| Example 39 | mixed dispersion 1 | mixed dispersion 2 | 6.5 | 309 |
| Example 40 | mixed dispersion 1 | mixed dispersion 2 | 7.5 | 48 |
| Example 41 | mixed dispersion 20 | mixed dispersion 2 | 7.0 | 143 |
| Comparative Example 1 | none | none | 9.08 | 143 |
| Comparative Example 2 | mixed dispersion 1 | mixed dispersion 2 | 6.98 | 143 |
| Comparative Example 3 | mixed dispersion 1 | mixed dispersion 2 | 6.98 | 143 |
| Comparative Example 4 | mixed dispersion 21 | mixed dispersion 22 | 6.98 | 143 |
| Comparative Example 5*3 | mixed dispersion 1 | mixed dispersion 18 | 6.98 | 143 |
| Comparative Example 6 | mixed dispersion 1 | mixed dispersion 19 | 6.98 | 143 |

*1No hybrid resins are contained.
*2A resin containing a crystalline polyester resin alone is used instead of a hybrid resin.
*3No hydrocarbon waxes are contained.
*4No vinyl resins are contained.

TABLE 4

| | Average area fraction in region extending from center of toner particle toward surface of toner particle by half distance from surface to center | | Average area fraction in region extending from surface of toner particle toward center of toner particle by half distance from surface to center | | Average area fraction in entire toner particle | | | Average size in entire toner particle [μm] | | |
|---|---|---|---|---|---|---|---|---|---|---|
| | Hybrid resin domains | Release agent domains | Hybrid resin domains | Release agent domains | Hybrid resin domains | Release agent domains | Ratio of average area fractions | Hybrid resin domains | Release agent domains | Ratio |
| Example 1 | 3.6 | 11.1 | 10.2 | 2.1 | 13.8 | 13.2 | 1.0 | 0.61 | 1.1 | 0.55 |
| Example 2 | 4.1 | 10.6 | 10.4 | 2.4 | 14.5 | 13.0 | 1.1 | 0.61 | 1.2 | 0.51 |
| Example 3 | 4.0 | 11.6 | 10.1 | 1.4 | 14.1 | 13.0 | 1.1 | 0.56 | 1.1 | 0.51 |
| Example 4 | 4.0 | 10.6 | 10.1 | 2.6 | 14.1 | 13.2 | 1.1 | 0.61 | 1.2 | 0.51 |
| Example 5 | 4.4 | 11.7 | 10.0 | 2.1 | 14.4 | 13.8 | 1.0 | 0.64 | 1.1 | 0.58 |
| Example 6 | 4.1 | 10.1 | 10.4 | 2.0 | 14.5 | 12.1 | 1.2 | 0.64 | 1.2 | 0.53 |
| Example 7 | 4.0 | 10.6 | 10.6 | 2.0 | 14.6 | 12.6 | 1.2 | 0.61 | 1.1 | 0.55 |
| Example 8 | 4.1 | 10.4 | 11.0 | 1.9 | 15.1 | 12.3 | 1.2 | 0.62 | 1.1 | 0.56 |
| Example 9 | 4.3 | 10.2 | 10.9 | 2.1 | 15.2 | 12.3 | 1.2 | 0.67 | 1.2 | 0.56 |
| Example 10 | 4.0 | 10.3 | 10.9 | 2.2 | 14.9 | 12.5 | 1.2 | 0.61 | 1.1 | 0.55 |
| Example 11 | 4.0 | 10.3 | 10.8 | 2.1 | 14.8 | 12.4 | 1.2 | 0.66 | 1.1 | 0.60 |
| Example 12 | 4.4 | 10.1 | 10.9 | 2.1 | 15.3 | 12.2 | 1.3 | 0.65 | 1.2 | 0.54 |
| Example 13 | 4.1 | 10.6 | 10.4 | 2.1 | 14.5 | 12.7 | 1.1 | 0.61 | 1.3 | 0.47 |
| Example 14 | 4.1 | 10.2 | 10.1 | 1.9 | 14.2 | 12.1 | 1.2 | 0.61 | 1.1 | 0.55 |
| Example 15 | 4.1 | 10.6 | 10.4 | 1.6 | 14.5 | 12.2 | 1.2 | 0.58 | 1.1 | 0.53 |
| Example 16 | 4.6 | 10.1 | 10.8 | 1.6 | 15.4 | 11.7 | 1.3 | 0.59 | 1.1 | 0.54 |
| Example 17 | 4.6 | 10.4 | 10.4 | 2.1 | 15.0 | 12.5 | 1.2 | 0.61 | 1.2 | 0.51 |
| Example 18 | 4.5 | 10.3 | 10.2 | 2.0 | 14.7 | 12.3 | 1.2 | 0.59 | 1.1 | 0.54 |
| Example 19 | 4.4 | 10.2 | 10.0 | 1.9 | 14.4 | 12.1 | 1.2 | 0.57 | 1.1 | 0.52 |
| Example 20 | 3.8 | 10.6 | 10.1 | 1.7 | 13.9 | 12.3 | 1.1 | 0.59 | 1.1 | 0.54 |
| Example 21 | 4.0 | 10.0 | 10.0 | 2.0 | 14.0 | 12.0 | 1.2 | 0.60 | 2.0 | 0.30 |
| Example 22 | 4.1 | 11.8 | 10.0 | 3.1 | 14.1 | 14.9 | 0.9 | 0.64 | 0.5 | 1.21 |
| Example 23 | 4.4 | 9.8 | 10.2 | 1.1 | 14.6 | 10.9 | 1.3 | 0.60 | 2.2 | 0.27 |

TABLE 4-continued

| | | | | | | | | | | |
|---|---|---|---|---|---|---|---|---|---|---|
| Example 24 | 4.0 | 12.6 | 11.0 | 4.1 | 15.0 | 16.7 | 0.9 | 0.60 | 0.4 | 1.50 |
| Example 25 | 4.1 | 10.1 | 9.8 | 2.0 | 13.9 | 12.1 | 1.1 | 1.10 | 1.1 | 1.00 |
| Example 26 | 4.8 | 11.0 | 11.1 | 2.1 | 15.9 | 13.1 | 1.2 | 0.40 | 1.1 | 0.36 |
| Example 27 | 3.8 | 10.5 | 10.2 | 2.4 | 14.0 | 12.9 | 1.1 | 1.20 | 1.1 | 1.07 |
| Example 28 | 5.1 | 10.8 | 11.4 | 2.6 | 16.5 | 13.4 | 1.2 | 0.20 | 1.1 | 0.18 |
| Example 29 | 6.4 | 8.1 | 14.0 | 2.0 | 20.4 | 10.1 | 2.0 | 0.60 | 1.1 | 0.55 |
| Example 30 | 3.2 | 16.4 | 7.0 | 3.6 | 10.2 | 20.0 | 0.5 | 0.59 | 1.0 | 0.59 |
| Example 31 | 6.3 | 7.4 | 16.0 | 1.3 | 22.3 | 8.7 | 2.6 | 0.58 | 1.1 | 0.53 |
| Example 32 | 2.4 | 16.6 | 6.0 | 5.0 | 8.4 | 21.6 | 0.4 | 0.61 | 0.9 | 0.68 |
| Example 33 | 4.3 | 12.9 | 10.2 | 4.1 | 14.5 | 17.0 | 0.9 | 0.61 | 1.3 | 0.47 |
| Example 34 | 4.1 | 8.0 | 10.4 | 1.4 | 14.5 | 9.4 | 1.5 | 0.67 | 1.0 | 0.67 |
| Example 35 | 4.6 | 14.3 | 10.6 | 4.6 | 15.2 | 18.9 | 0.8 | 0.64 | 1.3 | 0.49 |
| Example 36 | 4.7 | 6.4 | 10.8 | 1.1 | 15.5 | 7.5 | 2.1 | 0.61 | 0.9 | 0.68 |
| Example 37 | 6.8 | 11.4 | 14.4 | 2.1 | 21.2 | 13.5 | 1.6 | 0.71 | 1.1 | 0.65 |
| Example 38 | 2.1 | 11.6 | 7.5 | 2.4 | 9.6 | 14.0 | 0.7 | 0.51 | 1.1 | 0.46 |
| Example 39 | 6.8 | 11.7 | 17.0 | 2.0 | 23.8 | 13.7 | 1.7 | 0.77 | 1.1 | 0.70 |
| Example 40 | 1.7 | 10.6 | 5.7 | 2.1 | 7.4 | 12.7 | 0.6 | 0.50 | 1.1 | 0.45 |
| Example 41 | 10.6 | 11.4 | 3.1 | 2.1 | 13.7 | 13.5 | 1.0 | 0.68 | 1.2 | 0.57 |
| Comparative Example 1 | 3.6 | 3.2 | 10.7 | 10.8 | 14.3 | 14.0 | 1.0 | 0.64 | 1.6 | 0.40 |
| Comparative Example 2*[1] | — | 10.7 | — | 2.1 | — | 12.8 | — | 0.61 | 1.1 | — |
| Comparative Example 3*[2] | 3.7 | 11.2 | 10.8 | 2.4 | 14.5 | 13.6 | 1.1 | 0.66 | 1.1 | 0.60 |
| Comparative Example 4*[4] | 4.0 | 10.9 | 11.0 | 2.6 | 15.0 | 13.5 | 1.1 | 0.66 | 1.6 | 0.41 |
| Comparative Example 5*[3] | 3.7 | 10.7 | 11.1 | 2.1 | 14.8 | 12.8 | 1.2 | 0.61 | 1.2 | 0.51 |
| Comparative Example 6 | 12.4 | 3.4 | 3.3 | 11.6 | 15.7 | 15 | 1.0 | 0.64 | 1.3 | 0.49 |

| | | | Number of carbon atoms | | | Release agent/ | Hybrid resin/ | Evaluation | |
|---|---|---|---|---|---|---|---|---|---|
| | Lwax [μm] | Lhyb [μm] | Ccry | Cwax | Ccry/ Cwax | toner particles [w %] | release agent [w %] | Filming | Low-temperature fixability |
| Example 1 | 0.6 | 1.7 | 18 | 50 | 0.36 | 7.0 | 143 | A | A |
| Example 2 | 1 | 1.7 | 18 | 50 | 0.36 | 7.0 | 143 | A | B |
| Example 3 | 0.4 | 1.7 | 18 | 50 | 0.36 | 7.0 | 143 | B | A |
| Example 4 | 1.2 | 1.9 | 18 | 50 | 0.36 | 7.0 | 143 | A | C |
| Example 5 | 0.3 | 1.6 | 18 | 50 | 0.36 | 7.0 | 143 | C | A |
| Example 6 | 0.6 | 1.7 | 22 | 50 | 0.44 | 7.0 | 143 | A | B |
| Example 7 | 0.5 | 1.7 | 10 | 50 | 0.20 | 7.0 | 143 | B | B |
| Example 8 | 0.6 | 1.7 | 8 | 50 | 0.16 | 7.0 | 143 | C | B |
| Example 9 | 0.5 | 1.7 | 24 | 50 | 0.48 | 7.0 | 143 | B | C |
| Example 10 | 0.6 | 1.6 | 18 | 70 | 0.26 | 7.0 | 143 | B | B |
| Example 11 | 0.5 | 1.7 | 18 | 36 | 0.50 | 7.0 | 143 | B | B |
| Example 12 | 0.6 | 1.8 | 18 | 75 | 0.24 | 7.0 | 143 | C | B |
| Example 13 | 0.6 | 1.8 | 18 | 30 | 0.60 | 7.0 | 143 | B | C |
| Example 14 | 0.7 | 1.7 | 10 | 36 | 0.28 | 7.0 | 143 | B | B |
| Example 15 | 0.6 | 1.7 | 22 | 70 | 0.31 | 7.0 | 143 | B | A |
| Example 16 | 0.6 | 1.7 | 10 | 70 | 0.14 | 7.0 | 143 | C | B |
| Example 17 | 0.5 | 1.7 | 22 | 36 | 0.61 | 7.0 | 143 | B | C |
| Example 18 | 0.6 | 1.7 | 18 | 50 | 0.36 | 7.0 | 143 | B | B |
| Example 19 | 0.6 | 1.7 | 18 | 50 | 0.36 | 7.0 | 143 | C | B |
| Example 20 | 0.6 | 1.5 | 18 | 50 | 0.36 | 7.0 | 143 | B | C |
| Example 21 | 0.7 | 1.6 | 18 | 50 | 0.36 | 7.0 | 143 | B | B |
| Example 22 | 0.7 | 1.7 | 18 | 50 | 0.36 | 7.0 | 143 | B | B |
| Example 23 | 0.6 | 1.7 | 18 | 50 | 0.36 | 7.0 | 143 | C | B |
| Example 24 | 0.6 | 1.7 | 18 | 50 | 0.36 | 7.0 | 143 | C | B |
| Example 25 | 0.6 | 1.7 | 18 | 50 | 0.36 | 7.0 | 143 | B | B |
| Example 26 | 0.6 | 1.8 | 18 | 50 | 0.36 | 7.0 | 143 | B | B |
| Example 27 | 0.6 | 1.7 | 18 | 50 | 0.36 | 7.0 | 143 | B | C |
| Example 28 | 0.6 | 1.7 | 18 | 50 | 0.36 | 7.0 | 143 | C | B |
| Example 29 | 0.6 | 1.7 | 18 | 50 | 0.36 | 6.6 | 214 | B | B |
| Example 30 | 0.6 | 1.8 | 18 | 50 | 0.36 | 11.1 | 50 | B | B |
| Example 31 | 0.6 | 1.7 | 18 | 50 | 0.36 | 6.5 | 258 | C | B |
| Example 32 | 0.6 | 1.7 | 18 | 50 | 0.36 | 11.1 | 50 | B | C |
| Example 33 | 0.6 | 1.7 | 18 | 50 | 0.36 | 8.9 | 109 | A | B |
| Example 34 | 0.8 | 1.7 | 18 | 50 | 0.36 | 3.1 | 333 | B | B |
| Example 35 | 0.6 | 1.6 | 18 | 50 | 0.36 | 9.2 | 106 | B | C |
| Example 36 | 0.85 | 1.7 | 18 | 50 | 0.36 | 2.8 | 370 | C | B |
| Example 37 | 0.6 | 1.4 | 18 | 50 | 0.36 | 6.6 | 214 | B | A |
| Example 38 | 0.6 | 1.7 | 18 | 50 | 0.36 | 7.3 | 71 | A | B |
| Example 39 | 0.7 | 1.3 | 18 | 50 | 0.36 | 6.5 | 309 | C | A |
| Example 40 | 0.6 | 1.7 | 18 | 50 | 0.36 | 7.5 | 48 | A | C |
| Example 41 | 0.6 | 0.7 | 18 | 50 | 0.36 | 7.0 | 143 | C | A |

TABLE 4-continued

| | | | | | | | | | |
|---|---|---|---|---|---|---|---|---|---|
| Comparative Example 1 | 1.7 | 1.6 | 18 | 50 | 0.36 | 9.1 | 143 | D | B |
| Comparative Example 2*[1] | 0.6 | — | — | 50 | — | 7.0 | 143 | A | D |
| Comparative Example 3*[2] | 0.6 | 1.7 | 18 | 50 | 0.36 | 7.0 | 143 | D | B |
| Comparative Example 4*[4] | 0.6 | 1.7 | 18 | 43 | 0.42 | 7.0 | 143 | D | B |
| Comparative Example 5*[3] | 0.6 | 1.7 | 18 | 50 | 0.36 | 7.0 | 143 | D | B |
| Comparative Example 6 | 1.82 | 0.61 | 18 | 50 | 0.36 | 7.0 | 143 | D | A |

*[1]No hybrid resins are contained.
*[2]A resin containing a crystalline polyester resin alone is used instead of a hybrid resin.
*[3]No hydrocarbon waxes are contained.
*[4]No vinyl resins are contained.

The above results show that the toners of Examples 1 to 41 having the configuration according to the exemplary embodiment, as compared to the toners of Comparative Examples 1 to 6, have low-temperature fixability and are less likely to cause filming after storage at high temperature.

In particular, the toners of Examples 1 to 41 are less likely to cause filming than the toner of Comparative Example 3 not having the configuration according to the exemplary embodiment. The toner of Comparative Example 3, unlike the hybrid resins according to the exemplary embodiment, includes no amorphous resins but a crystalline resin alone. With such a configuration including a crystalline resin alone, the domains tend to move to be exposed on the surface side of the toner particle during storage at high temperature. Thus, the toner of Comparative Example 3 tends to cause filming regardless of the average area fractions of release agent domains and crystalline resin domains and the average distances from the surface of the toner particle to the centers of the domains.

In addition, the toners of Examples 1 to 41 are less likely to cause filming than the toner of Comparative Example 4 not having the configuration according to the exemplary embodiment. The toner of Comparative Example 4 does not include the vinyl resin according to the exemplary embodiment. Thus, the toner of Comparative Example 4, similarly to that of Comparative Example 3, tends to cause filming regardless of the average area fractions of release agent domains and hybrid resin domains and the average distances from the surface of the toner particle to the centers of the domains.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising:

a toner particle; and an external additive, the toner particle containing a binder resin and a release agent that includes a hydrocarbon wax, the binder resin including a vinyl resin and a hybrid resin in which an amorphous resin unit other than polyester resins and a crystalline polyester resin unit are chemically bound together, wherein the toner particle has hybrid resin domains and release agent domains, and an average distance Lhyb from a surface of the toner particle to centers of the hybrid resin domains and an average distance Lwax from the surface of the toner particle to centers of the release agent domains satisfy Lwax<Lhyb.

2. The electrostatic image developing toner according to claim 1, wherein Lwax is 0.4 μm or more and 1.0 μm or less.

3. An electrostatic image developing toner comprising:

a toner particle; and an external additive, the toner particle containing a binder resin and a release agent that includes a hydrocarbon wax, the binder resin including a vinyl resin and a hybrid resin in which an amorphous resin unit other than polyester resins and a crystalline polyester resin unit are chemically bound together, wherein the toner particle has hybrid resin domains and release agent domains, an average area fraction of the release agent domains present in a region extending from a center of the toner particle toward a surface of the toner particle by half a distance from the surface to the center is larger than an average area fraction of the hybrid resin domains present in the region, and an average area fraction of the release agent domains present in a region extending from the surface of the toner particle toward the center of the toner particle by half the distance from the surface to the center is smaller than an average area fraction of the hybrid resin domains present in the region.

4. The electrostatic image developing toner according to claim 1, wherein the crystalline polyester resin unit is a crystalline aliphatic polyester resin formed of a polycarboxylic acid component and a polyhydric alcohol component.

5. The electrostatic image developing toner according to claim 4, wherein Ccry, which is a sum of the number of carbon atoms of the polycarboxylic acid component and the number of carbon atoms of the polyhydric alcohol component, is 8 or more and 22 or less.

6. The electrostatic image developing toner according to claim 1, wherein Cwax, which is the number of carbon atoms of the hydrocarbon wax, is 35 or more and 70 or less.

7. The electrostatic image developing toner according to claim 5, wherein Ccry, which is the sum of the number of carbon atoms of the polycarboxylic acid component and the number of carbon atoms of the polyhydric alcohol component, and Cwax, which is the number of carbon atoms of the hydrocarbon wax, satisfy 0.25<Ccry/Cwax<0.5.

8. The electrostatic image developing toner according to claim 1, wherein the amorphous resin unit other than polyester resins includes a polystyrene resin.

9. The electrostatic image developing toner according to claim 8, wherein the amorphous resin unit other than polyester resins further includes a polyurethane resin.

10. The electrostatic image developing toner according to claim 1, wherein the release agent domains have an average size of 0.5 μm or more and less than 2.0 μm.

11. The electrostatic image developing toner according to claim 10, wherein a ratio of the average size of the release agent domains to an average size of the hybrid resin domains is 0.3 or more and 1.0 or less.

12. The electrostatic image developing toner according to claim 1, wherein a ratio of an average area fraction of the release agent domains in the entire toner particle to an average area fraction of the hybrid resin domains in the entire toner particle is 0.5 or more and 2.0 or less.

13. The electrostatic image developing toner according to claim 1, wherein a content of the release agent in the toner particle is 5% by mass or more and less than 9% by mass.

14. The electrostatic image developing toner according to claim 13, wherein a content of the hybrid resin relative to the content of the release agent is 50% by mass or more and 300% by mass or less.

15. The electrostatic image developing toner according to claim 1, wherein the vinyl resin includes a styrene-(meth) acrylic resin.

16. An electrostatic latent image developer comprising the electrostatic image developing toner according to claim 1.

17. A toner cartridge attachable to and detachable from an image forming apparatus, the toner cartridge comprising the electrostatic image developing toner according to claim 1.

* * * * *